US010054408B2

(12) United States Patent
Wong et al.

(10) Patent No.: US 10,054,408 B2
(45) Date of Patent: Aug. 21, 2018

(54) PADDED ARROW HEAD

(71) Applicant: Team 3 Industries Inc., Markham (CA)

(72) Inventors: Edward Wai Cheung Wong, Markham (CA); Casper Chord Yan Wong, Markham (CA)

(73) Assignee: Team 3 Industries Inc., Markham (CA)

( * ) Notice: Subject to any disclaimer, the term of this patent is extended or adjusted under 35 U.S.C. 154(b) by 0 days.

(21) Appl. No.: 15/367,733

(22) Filed: Dec. 2, 2016

(65) Prior Publication Data

US 2017/0176153 A1 Jun. 22, 2017

Related U.S. Application Data

(60) Provisional application No. 62/270,594, filed on Dec. 22, 2015.

(51) Int. Cl.

| | |
|---|---|
| ***F42B 6/08*** | (2006.01) |
| ***F42B 6/04*** | (2006.01) |
| *F42B 6/06* | (2006.01) |

(52) U.S. Cl.

CPC ..... *F42B 6/08* (2013.01); *F42B 6/04* (2013.01); *F42B 6/06* (2013.01)

(58) Field of Classification Search

CPC ..... F42B 6/04; F42B 6/08
USPC ..... 473/571, 578, 582
See application file for complete search history.

(56) References Cited

U.S. PATENT DOCUMENTS 2,377,498 A * 6/1945 Jacke ..... A63B 67/086 473/569
2,531,635 A * 11/1950 Maager ..... F42B 6/08 473/585
2,621,441 A * 12/1952 Worden ..... A63H 5/00 40/413
2,836,930 A * 6/1958 Ragazzo ..... F42B 6/04 446/213
6,083,127 A * 7/2000 O'Shea ..... A63H 33/18 446/213

(Continued)

FOREIGN PATENT DOCUMENTS

DE 202004016059 U1 2/2005
EP 0911602 A2 4/1999

OTHER PUBLICATIONS

Fitz-Rauf, "Combat Archery: A Manual for Western Archers", 1995 (http://www.pbm.com/~lindahl/articles/combat.archery.html).

(Continued)

*Primary Examiner* — Alexander Niconovich
(74) *Attorney, Agent, or Firm* — Bereskin & Parr LLP/S.E.N.C.R.L., s.r.l.; Isis E. Caulder; Nicholas Aitken

(57) ABSTRACT

An application for a non-lethal arrow. The application may comprise a foam tip and may further comprise an elastic attachment mechanism and a base. The foam tip may comprise an impact end and a base connection end. The elastic attachment mechanism may comprise one or more elastic fingers. The base may comprise a shaft connection end and a flat supporting plate end. The ends of the finger or fingers of the elastic attachment mechanism may be secured to the base. The length of the finger or fingers may be elastically extended and wrapped around at least a portion of the foam tip, holding the foam tip against the flat support plate of the base.

15 Claims, 27 Drawing Sheets

(56) References Cited

U.S. PATENT DOCUMENTS

| | | | | |
|---|---|---|---|---|
| 7,601,084 | B2 * | 10/2009 | Martin | F42B 6/02 473/578 |
| 7,731,612 | B2 * | 6/2010 | Martin | F41J 3/0004 473/581 |
| 8,012,049 | B1 * | 9/2011 | Walterscheid | F42B 6/08 473/572 |
| 8,449,413 | B1 * | 5/2013 | Jackson | F42B 6/08 473/578 |
| 8,852,038 | B1 * | 10/2014 | Hyde | F42B 6/04 473/578 |
| 8,932,159 | B2 * | 1/2015 | Lennon | F42B 6/08 473/578 |
| 9,091,514 | B1 * | 7/2015 | Cummings | F42B 6/02 |
| 9,435,621 | B1 * | 9/2016 | Yeh | F42B 6/08 |
| 9,562,752 | B1 * | 2/2017 | Rappaport | F42B 6/04 |
| 2006/0014598 | A1 * | 1/2006 | Martin | F42B 6/08 473/578 |
| 2006/0276277 | A1 * | 12/2006 | Montefusco | F42B 8/16 473/586 |
| 2014/0256479 | A1 * | 9/2014 | Bynum, Jr. | F42B 6/08 473/470 |

OTHER PUBLICATIONS

Larson and Belegarth Medieval Combat Society, "Constructing Arrows", BelegarthWiki, 2016 (http://geddon.org/Constructing_Arrows).

* cited by examiner

101

PADDED ARROW HEAD

FIELD

The embodiments disclosed herein relate generally to an arrow. More particularly the embodiments disclosed herein relate to a nonlethal arrow head for use in recreational archery.

BACKGROUND

The following paragraphs are not an admission that anything discussed in them is prior art or part of the knowledge of persons skilled in the art.

Archery has been part of human culture for many years. It has been used at least in hunting, warfare, and recreational activities.

Recreational archery often requires the use of non-lethal arrow heads. Accordingly, there is a need for arrows and arrow heads that are non-lethal. There is also a general commercial need for arrows and arrow heads which are easy to manufacture, simple to put together, and durable.

In addition, the wear and tear upon these arrow heads often causes certain components to wear out faster than others. As a result, there is a need for a substantially modular non-lethal arrow head design, allowing components to be replaced individually when necessary.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In an aspect, there is provided a padded head assembly for an arrow. The padded head assembly may comprise a foam tip, an elastic attachment mechanism, and a base. The foam tip may comprise an impact end and a base connection end. The elastic attachment mechanism may comprise one or more elastic fingers. The base may comprise a shaft connection end and a flat supporting plate end. The ends of the finger or fingers of the elastic attachment mechanism may be secured to the base. The length of the finger or fingers may be elastically extended and wrapped around at least a portion of the foam tip, holding the foam tip against the flat support plate of the base.

The base can comprise a shaft connection end comprising an elongated cylindrical portion having a hollow interior and having first and second ends, wherein an arrow shaft can be fitted into the hollow interior from the first end. The base may further comprise a flat support plate having upper and lower faces. The second end of the elongate cylindrical portion may be connected to the center of the lower face of the flat support plate.

The flat support plate may have a central opening through the plate from the upper face to the lower face. This opening may be positioned in line with the hollow interior of the attached elongate cylindrical portion of the shaft connection end.

The base may be attached to the arrow shaft by a threaded fastener. The arrow shaft may be fitted into the hollow interior of the shaft connection end of the base from the first end of the shaft connection end. The threaded fastener may then be passed through the central opening in the flat support plate from the upper face to the lower face and threaded into a threaded insert located on one end of a commercially available arrow shaft.

Alternately, the base may be attached to the arrow shaft by a threaded fastener integrally attached to the base. This threaded fastener may be positioned in line with the hollow interior of the elongate cylindrical portion, extending away from the lower face of the flat support plate.

The padded head assembly may further comprise a plurality of fins tapering downwards from the flat support plate and attached to the elongated cylindrical portion. These fins may provide support for the flat support plate. These fins may include a securing notch for connection with the elastic attachment mechanism.

The flat support plate may have one or more holes or slots in addition to the central opening. These holes or slots may be provided so that the fingers of the elastic attachment mechanism may extend past the flat support plate without passing over the outer rim of the flat support plate The elastic fingers may be of non-uniform diameter, so that one or more portions of each particular finger are of greater diameter then the rest of the particular finger. These portions of greater diameter may be used to secure the fingers to the base by placing the particular finger in the securing notches in the fins.

The elastic fingers of the elastic attachment mechanism may also be secured in place to the base by means of tying the fingers to a portion of the base.

The foam tip may be solid piece of foam without cavities.

The foam tip may include a cavity to hold a whistle insert. The cavity may be in the side of the foam tip, extending from the exterior and in a direction perpendicular to the axis of the foam tip.

The foam tip may be cylindrical in shape along its axis, with a first and second end. The first end of the foam tip may be flat and the second end may be shaped as a half sphere.

The foam tip may have one or more passages parallel to its axis through with the elastic attachment mechanism may extend.

The padded head assembly may further comprise a protective housing. This protective housing may cover at least a portion of the base.

The protective housing may be a sleeve substantially in the shape of a hollow conical frustum. The smaller of the two ends of the frustum may be just large enough for the arrow shaft to pass through. The hollow conical frustum body may protect at least a portion of the base of the padded head assembly.

The padded head assembly with the protective housing may further comprise an elastic retaining ring. This ring may be elastically extended and placed on the shaft with its axis parallel to the axis of the shaft. The ring may be placed against the narrow portion of the protective housing to hold the protective housing against the base by means of friction.

The padded head assembly may further comprise an arrow shaft attached to the shaft connection end of the base of the padded head assembly, and a fletching sleeve slid onto the shaft tail end. This fletched sleeve may be adjustably secured onto the arrow shaft in a position along the shaft such that it balances the padded head assembly during flight.

In another aspect, there is provided a foam head that may be used with the padded head assembly described, and may be a replacement foam head for the foam tip of the padded head assembly described. This foam head may comprise a substantially cylindrical piece of foam with a flat base connection end and an impact end. This foam head may be substantially solid, or may be substantially solid save for one or more passages through which elastic fingers may be passed.

In another aspect there is provided a method of attaching a non-lethal arrow head to an arrow shaft. This method would comprise attaching a base to an arrow shaft. The base would comprise a flat support plate having first and second faces, with the first face secured to the second end of a hollow elongate cylindrical portion having first and second ends. This method would comprise attaching the base to a shaft head end of the arrow shaft by inserting the shaft head end into the first end of the hollow elongate cylindrical portion. The base and arrow shaft would then be fastened together by means of a threaded fastener passed through an opening in the base and threaded into a threaded insert in the arrow shaft. A foam tip, consisting of a cylindrical foam body with a flat first end and a spherical second end, would be pressed against the base, with the second face of the flat support plate of the base pressed against the first end of the foam tip. Finally the base and the foam tip would be secured together by means of an elastic securing mechanism consisting of one or more elastic fingers. The ends of the finger or fingers would be secured to the base and the finger or fingers would be wrapped around at least of portion of the foam tip, holding the at least a portion of the foam tip against the flat support plate.

The method of attaching a non-lethal arrow head to an arrow shaft may further include sliding a fletched sleeve onto the shaft tail end of the arrow shaft and securing that sleeve at a position along the length of the arrow shaft such that it is able to balance the non-lethal arrow head during flight.

BRIEF DESCRIPTION OF THE DIAGRAMS

The drawings included herewith are for illustrating various examples of articles and apparatuses of the teaching of the present specification and are not intended to limit the scope of what is taught in any way.

For a better understanding of the described embodiments and to show more clearly how they may be carried into effect, reference will now be made, by way of example, to the accompanying drawings in which.

DETAILED DESCRIPTION

Figure 1:
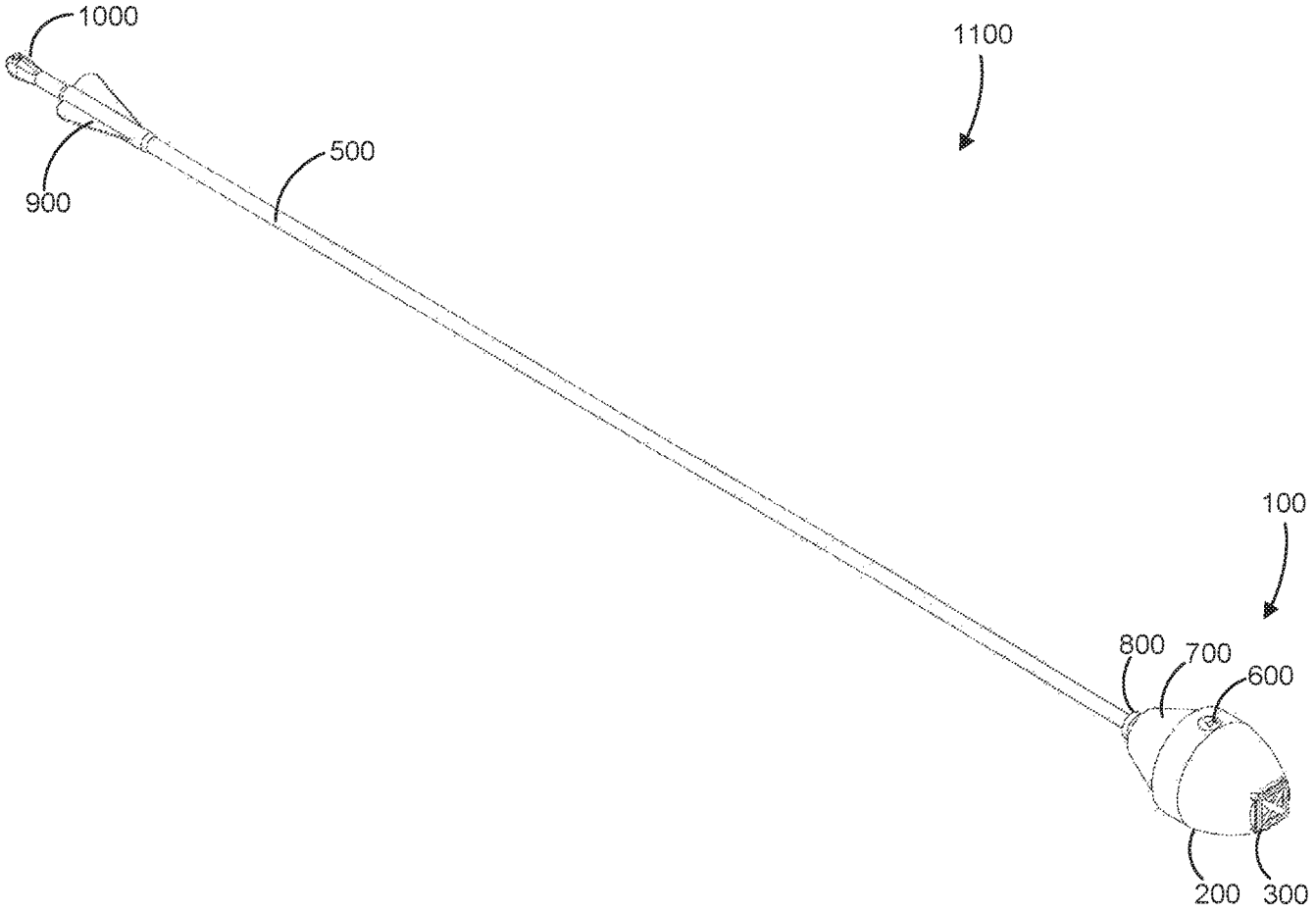
FIG. 1 is an isometric view of an example padded head assembly for an arrow according to a first embodiment.

For simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments generally described herein.

Various apparatuses or processes will be described below to provide examples of embodiments of what is claimed. No embodiment described below limits what is claimed and what is claimed may cover processes or apparatuses that differ from those described below. What is claimed is not limited to apparatuses or processes having all of the features of any one apparatus or process described below or to features common to multiple or all of the apparatuses described below. It is possible that an apparatus or process described below is not an embodiment of what is claimed. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 2:
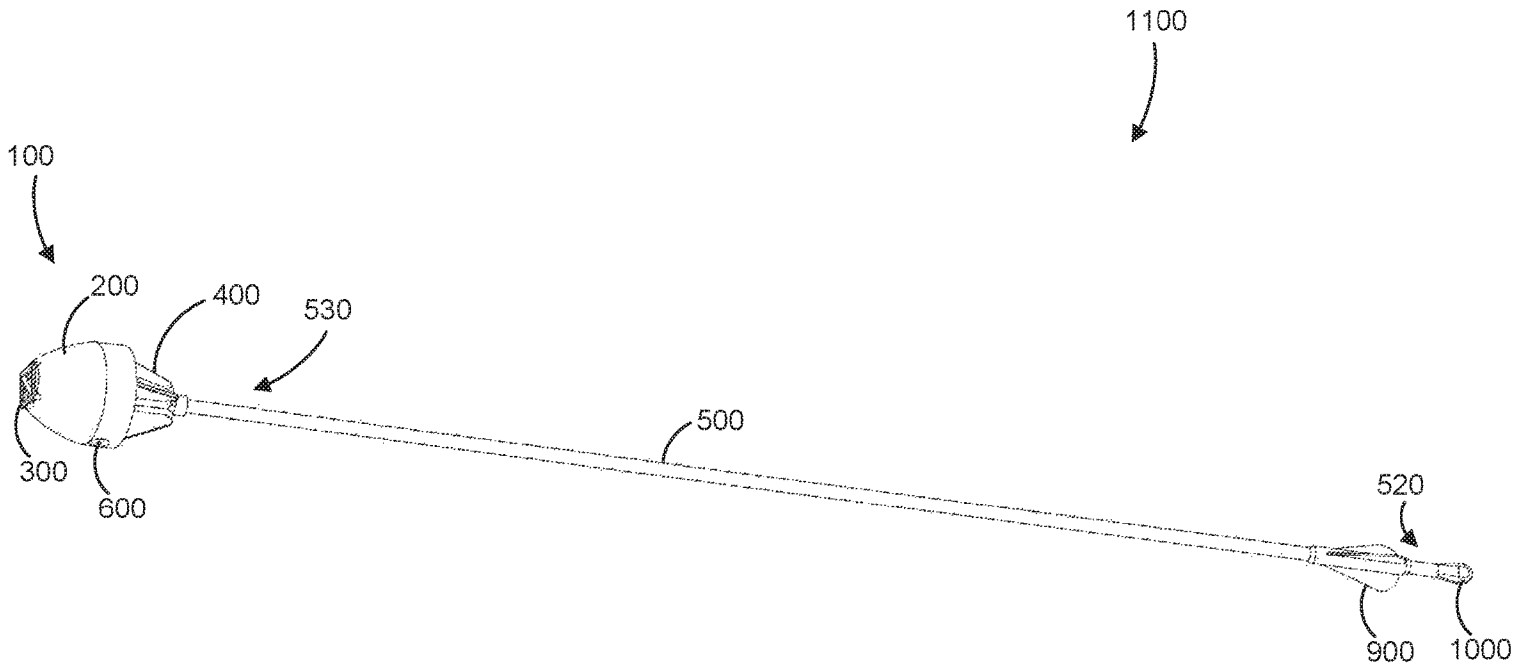
FIG. 2 is an isometric view of the example padded head assembly of FIG. 1 with an example of the protective housing removed to show an example of the base.

FIGS. 1 and 2 show an example of an arrow 1100 fitted with an example of a padded head assembly 100. The padded head assembly 100 shown in FIGS. 1 and 2 comprises a foam tip 200, an elastic attachment mechanism 300, and a base 400. The arrow 1100 shown in FIGS. 1 and 2 comprises the padded head assembly 100, an arrow shaft 500, a fletched sleeve 900, and a nock 1000.

Figure 26:
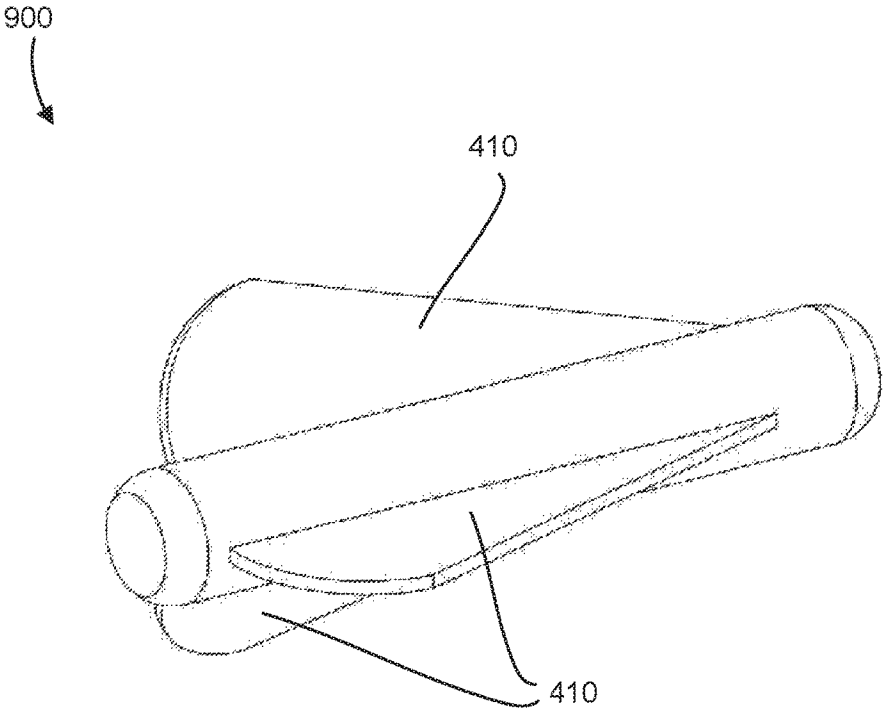
FIG. 26 is an isometric view of a first example fletching sleeve.

The fletched sleeve 900, also depicted in FIG. 26, is a hollow sleeve with at least one vane 910 attached, preferably the fletched sleeve 900 will have three vanes 910 attached. The fletched sleeve is configured to slide onto the arrow shaft 500 and secured permanently or temporarily, by means of adhesive, tape or any securing means known to one skilled in the art, in a position along the arrow shaft 500 that allows the fletched sleeve 900 to balance the weight and drag of a base 400 and foam tip 200 of an arrow equipped with an example of the padded head assembly 100 in flight.

Typically the fletched sleeve 900 will be positioned near the shaft tail end 520. However, as an arrow equipped with an example of the padded head assembly is used, the foam tip 200 is likely to wear down. As the foam tip 200 wears down, the user may find it helpful to adjust the fletched sleeve along the length of the arrow shaft 500 to better balance the weight and drag of a base 400 and foam tip 200 of an arrow equipped with an example of the padded head assembly 100 in flight.

Reference continues to be made to FIGS. 1 and 2. The padded head assembly may further comprise a nock 1000 secured on the end of the shaft tail end 520 of the arrow shaft 500, opposite the foam tip 200.

Figure 24:
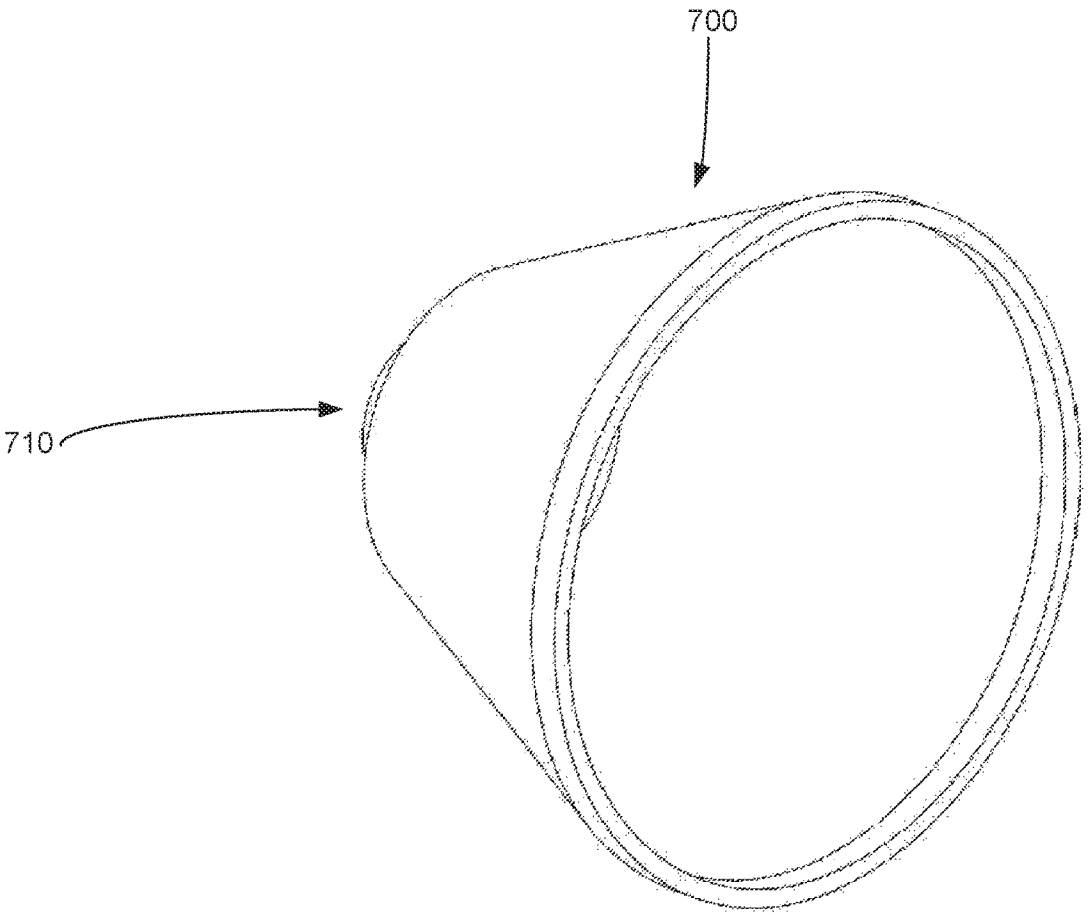
FIG. 24 is an isometric view of a first example protective housing.
Figure 25:
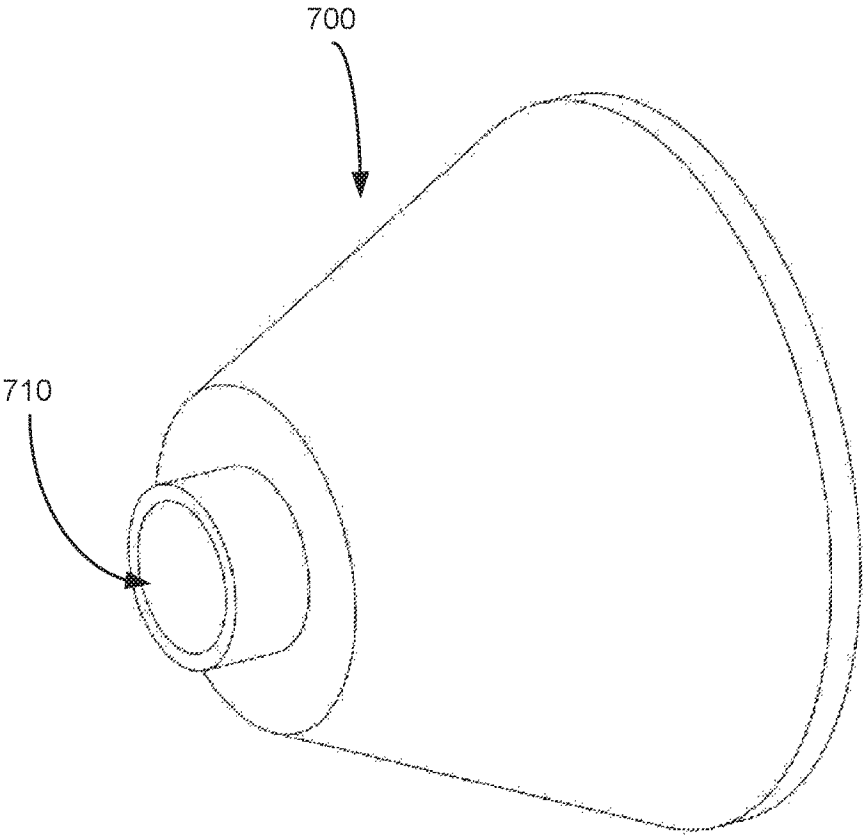
FIG. 25 is another isometric view of the first example protective housing of FIG. 24.

The padded head assembly may further comprise a protective housing 700, also depicted in FIGS. 24 and 25, held in place against the base 400 and the foam tip 200 by an elastic ring 800, such as an elastic O-ring. This O-ring keeps the protective housing 700 from sliding away from the base 400 and up the shaft 500 of an arrow 1100 equipped with an example of the padded head assembly 100. The elastic ring 800 may be elastically extended and placed against the protective housing 700, whereupon any movement of the protective housing 700 away from the base 400 would be blocked by the elastic ring 800 held in place by friction.

Continuing to refer to FIGS. 1 and 2, the padded head assembly may further comprise a whistle insert 600, which may be inserted into a whistle cavity 240 in the side of the foam tip 200. This whistle insert 600 may be provided to produce a whistling noise during the flight of an arrow fitted with an example of the padded head assembly 100.

Figure 3:
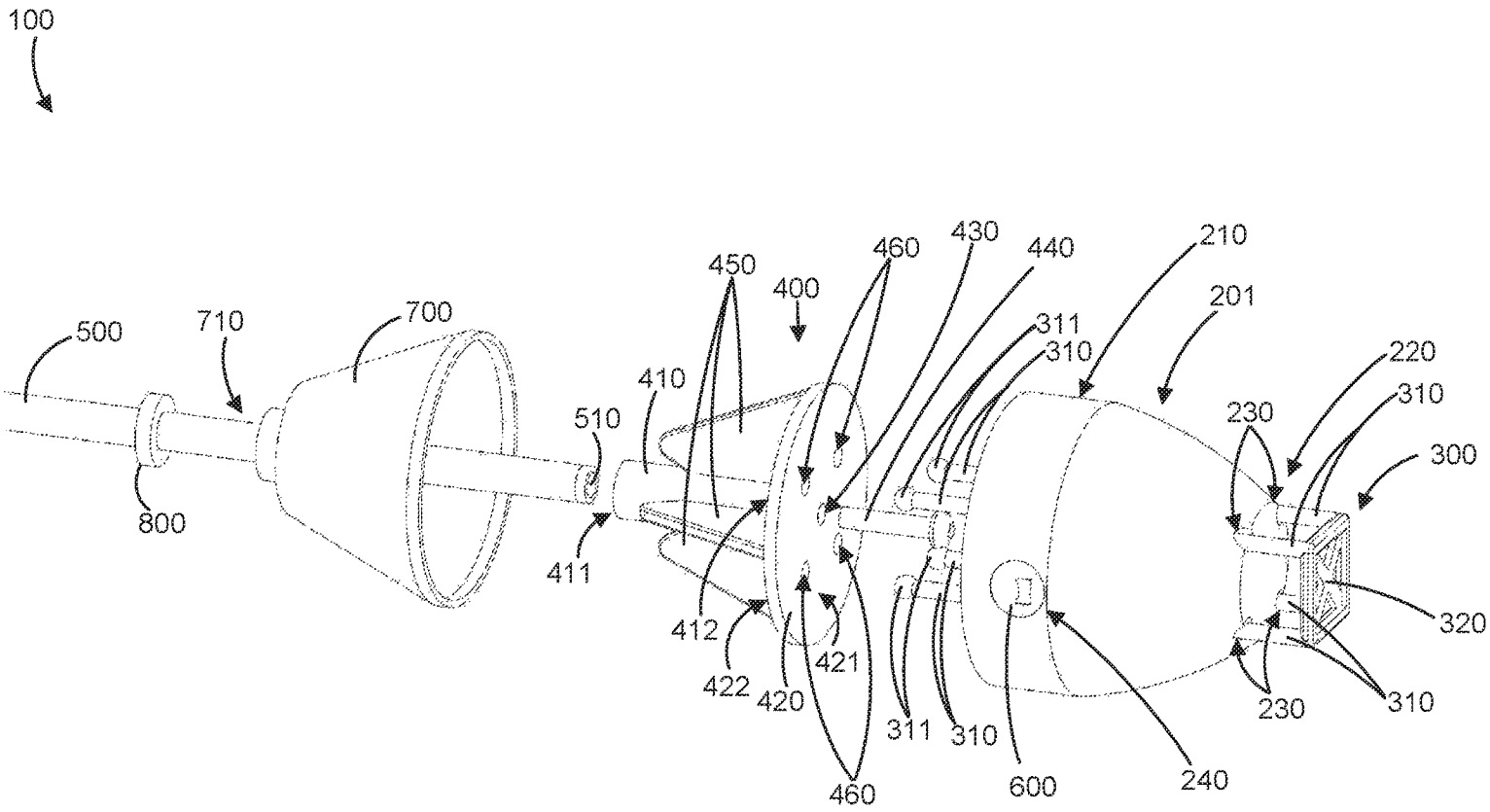
FIG. 3 is an isometric assembly view of the padded head assembly of FIG. 1.

Reference is now made to FIG. 3. The padded head assembly 100 shown in FIG. 3 comprises a first embodiment foam tip 201 of the foam tip 200, an elastic attachment mechanism 300, a base 400, a whistle insert 600, a protective housing 700, and an elastic retaining ring 800.

The foam tip 200, such as the foam tip depicted in FIG. 3 comprises a first end 210 and a second end 220. The first end 210 is typically flat, such that it may be held flush against the flat support plate 420 of the base 400. A flat first end 210 of the foam tip 201 biased against the flat support plate 420 of the base 400 ensures maximum surface area contact, allowing the force of impact of an arrow equipped with the padded head assembly to be dispersed as efficiently as possible.

The energy of an arrow is dependent on its mass and the speed at which it is traveling. This energy is transferred from the arrow 1100 into the foam tip 200 via the flat support plate 420 of the base 400. A larger contact area between the flat support plate 420 and the foam tip 200 allows for greater transfer of the arrow's energy into the foam tip 200.

The foam tip 201 depicted in FIG. 3 further comprises passages 230 bored substantially parallel to the arrow shaft 500, through which the fingers 310 of the elastic attachment mechanism 300 may be passed. A person skilled in the art will appreciate that although four passages 230 are depicted in FIG. 3, the number will depend on the number of fingers 310 used in the particular embodiment of the elastic attachment mechanism 300.

The foam tip 200, elastic attachment mechanism 300, base 400, arrow shaft 500, whistle insert 600, protective housing 700, elastic retaining ring 800, fletching sleeve 900, and nock 1000 may each be made from any known suitable material such as metal, rubber, plastic or other materials, so long as the materials in combination provide for the functionality described in this document. Preferably the components may be made of acrylonitrile butadiene styrene (ABS), polypropylene (PP), high-density polyethylene (HDPE), expanded polystyrene (EPS), Santoprene 103-40, or other similar materials. In some cases, the components may be individually or integrally 3D printed, cast, or injection molded.

The components disclosed herein may each be manufactured as single pieces, or may be manufactured in parts held together as known by one skilled in the art. For example, the base 400 may be a single piece of molded plastic. Alternatively the shaft connection end 410, flat support plate 420 and fins 450 may each be separate pieces of molded plastic secured together as known by one skilled in the art.

Figure 4:
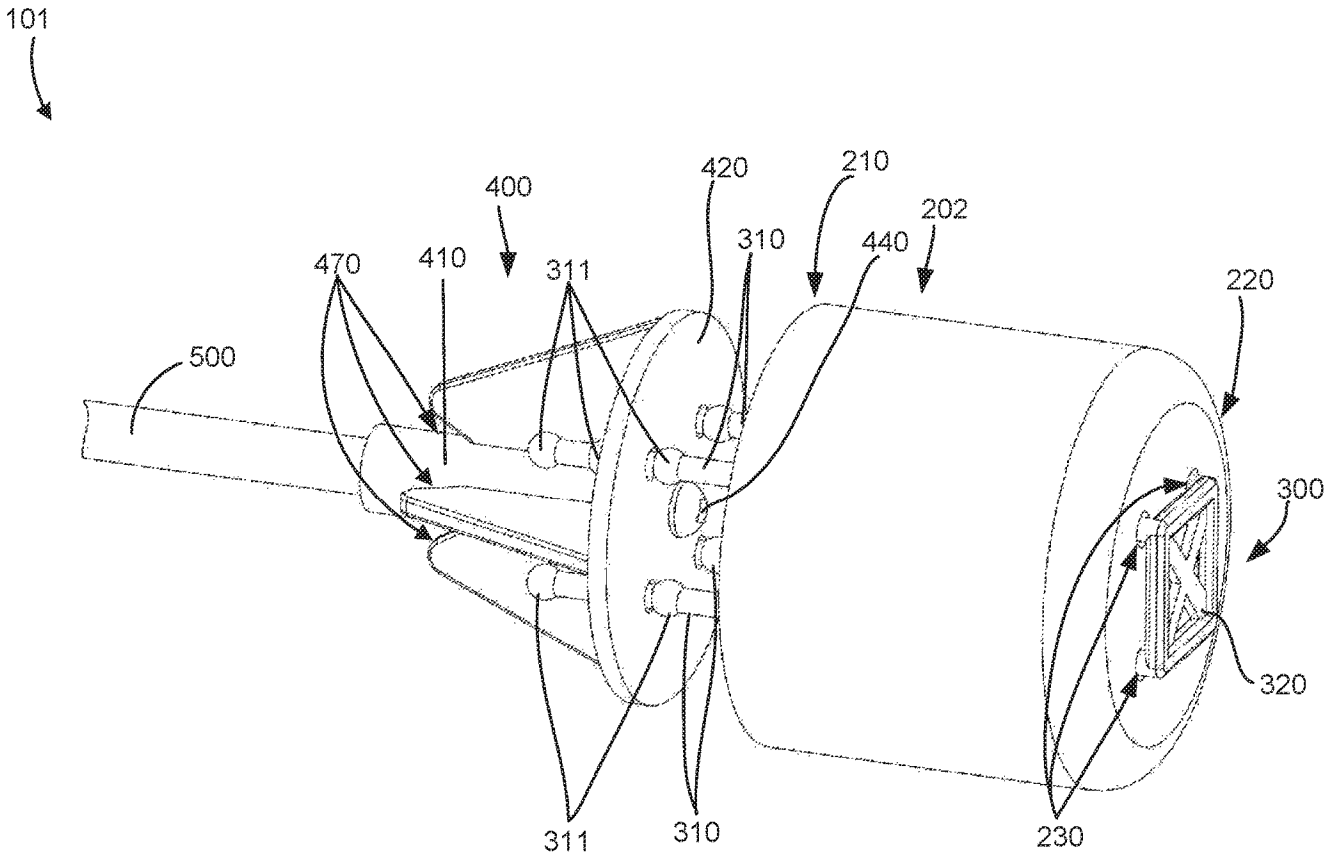
FIG. 4 is an isometric assembly view of a padded head assembly according to a second embodiment.

Reference is now made to FIG. 4, which depicts a different embodiment of the padded head assembly 101. This embodiment does not include a protective housing, elastic retaining ring, or whistle insert. In this embodiment the foam tip 202 is a substantially cylindrical piece of foam without a whistle insert cavity or a rounded second end as shown by the foam tip 201 depicted in FIG. 3. As in the embodiment depicted in FIG. 3, this foam tip 202 includes passages 230 through the foam tip 202 through which fingers 310 of the elastic attachment mechanism 300 may pass.

The elastic attachment mechanism 300 and the base 400 of this embodiment of the padded head assembly 101 are substantially similar to those depicted in FIG. 3.

Figure 5A:
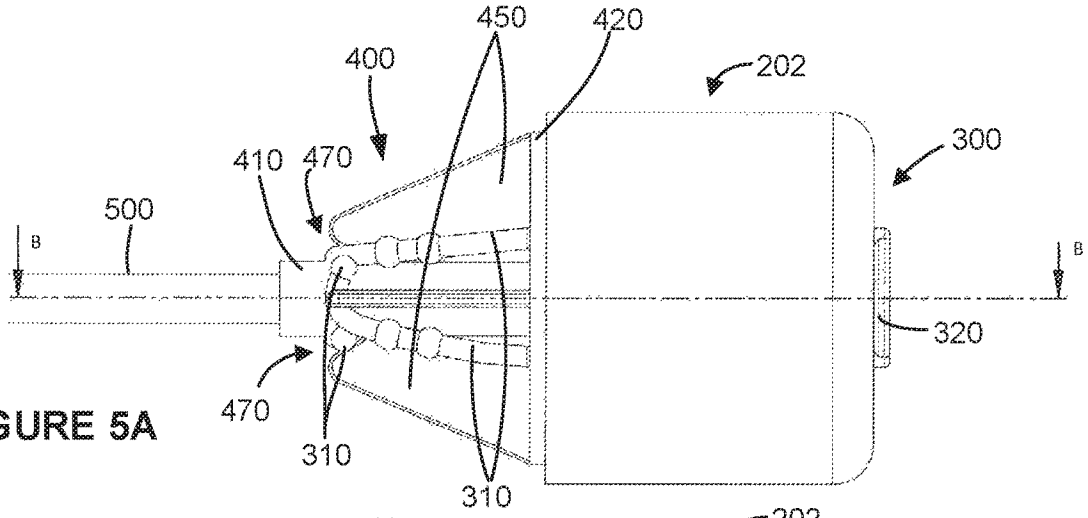
FIG. 5A is a side view of the padded head assembly of FIG. 4.
Figure 5B:
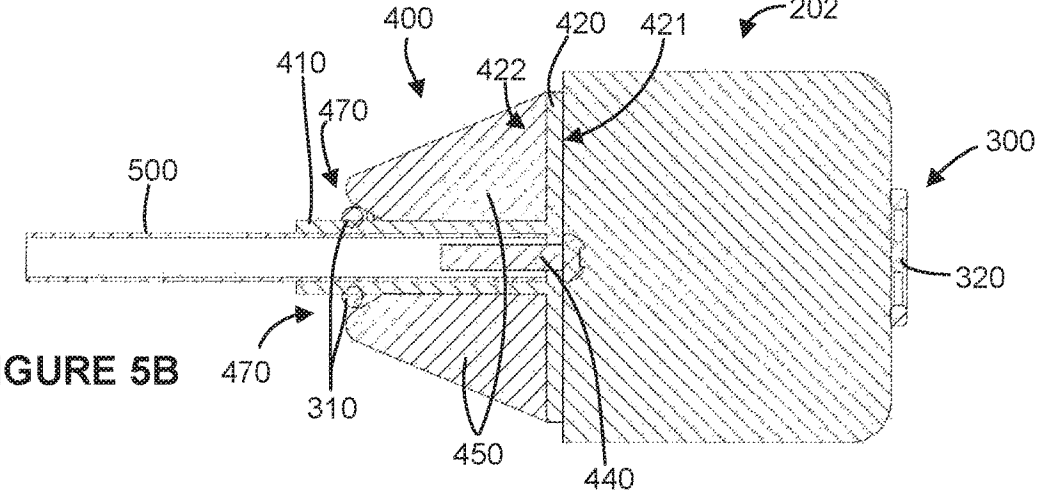
FIG. 5B is a cross section view taken along the line B-B of the padded head assembly of FIG. 5A.

FIGS. 5A and 5B depict a side view and a cross section respectively of the embodiment depicted in FIG. 4. FIG. 5B in particular is a cross section of FIG. 5A taken along the line from A to A. FIG. 5B shows the threaded fastener 440 of the base 400 threaded into the threaded insert 510 of the arrow shaft 500, and removably and securely holding the arrow shaft and the base together. A person skilled in the art will understand that the threaded fastener 440 may be integral to the base 400 rather than a separate piece. FIG. 5B also depicts the elastic fingers 310 secured in the notches 470 in the fins 450 of the base 400.

Figure 6:
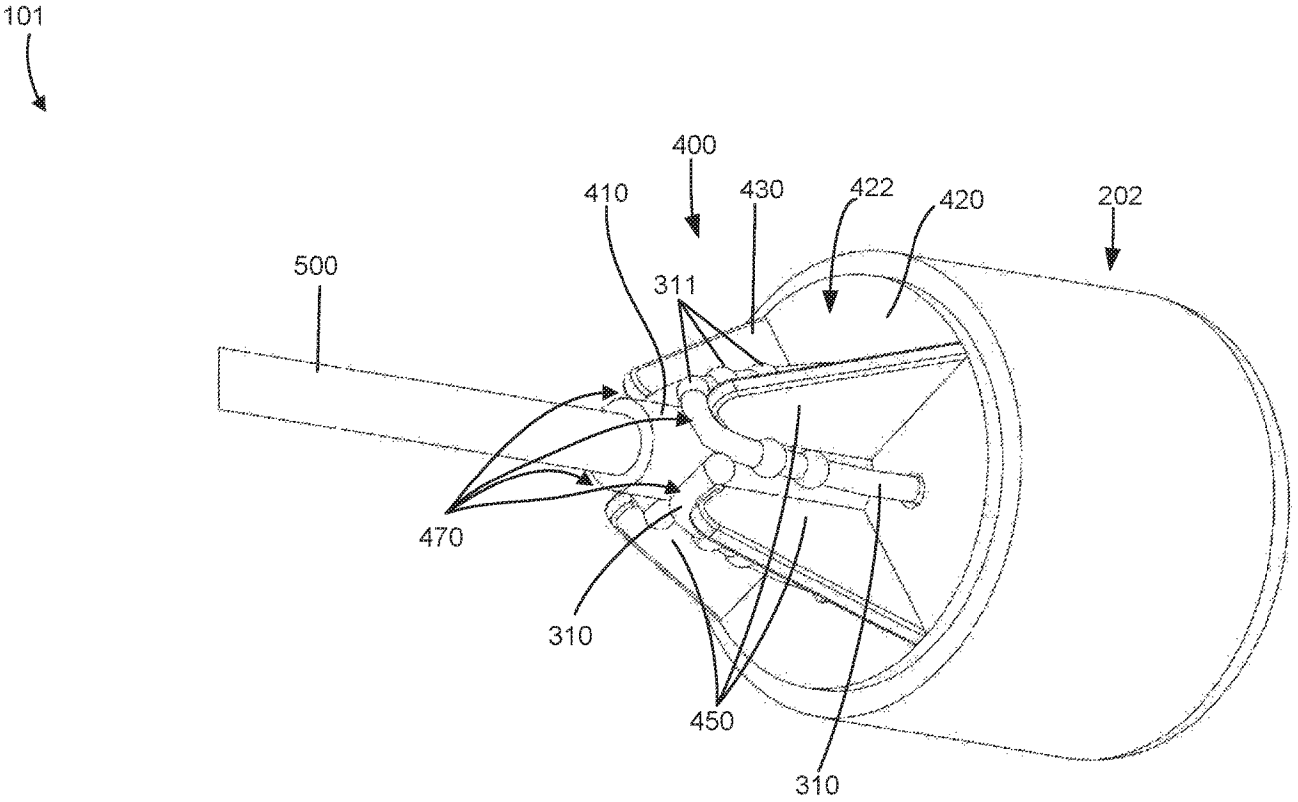
FIG. 6 is an isometric view of the padded head assembly of FIG. 4.

Reference is now made to FIG. 6 which is provided to better show how the elastic fingers 310 are secured in the notches 470 in the fins 450 of the base 400. As depicted in FIG. 6, the elastic fingers extend through the passages 230 in an example foam tip 202, through the holes or slots 460 of the base 400, and out to the notches 470 in the fins 450 of the base 400. The elastic fingers 310 as depicted in FIG. 6 include greater-diameter portions 311 which assist in securing the fingers 310 to the base 400.

Figure 7:
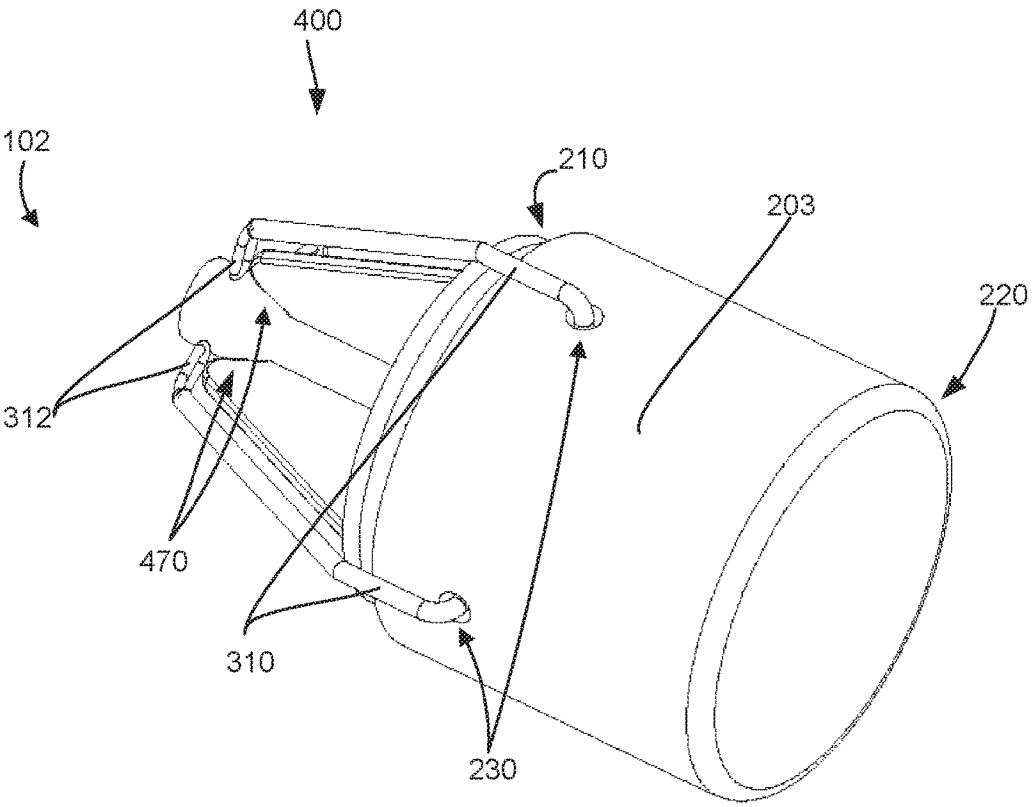
FIG. 7 is an isometric view of a padded head assembly according to a third embodiment.
Figure 8:
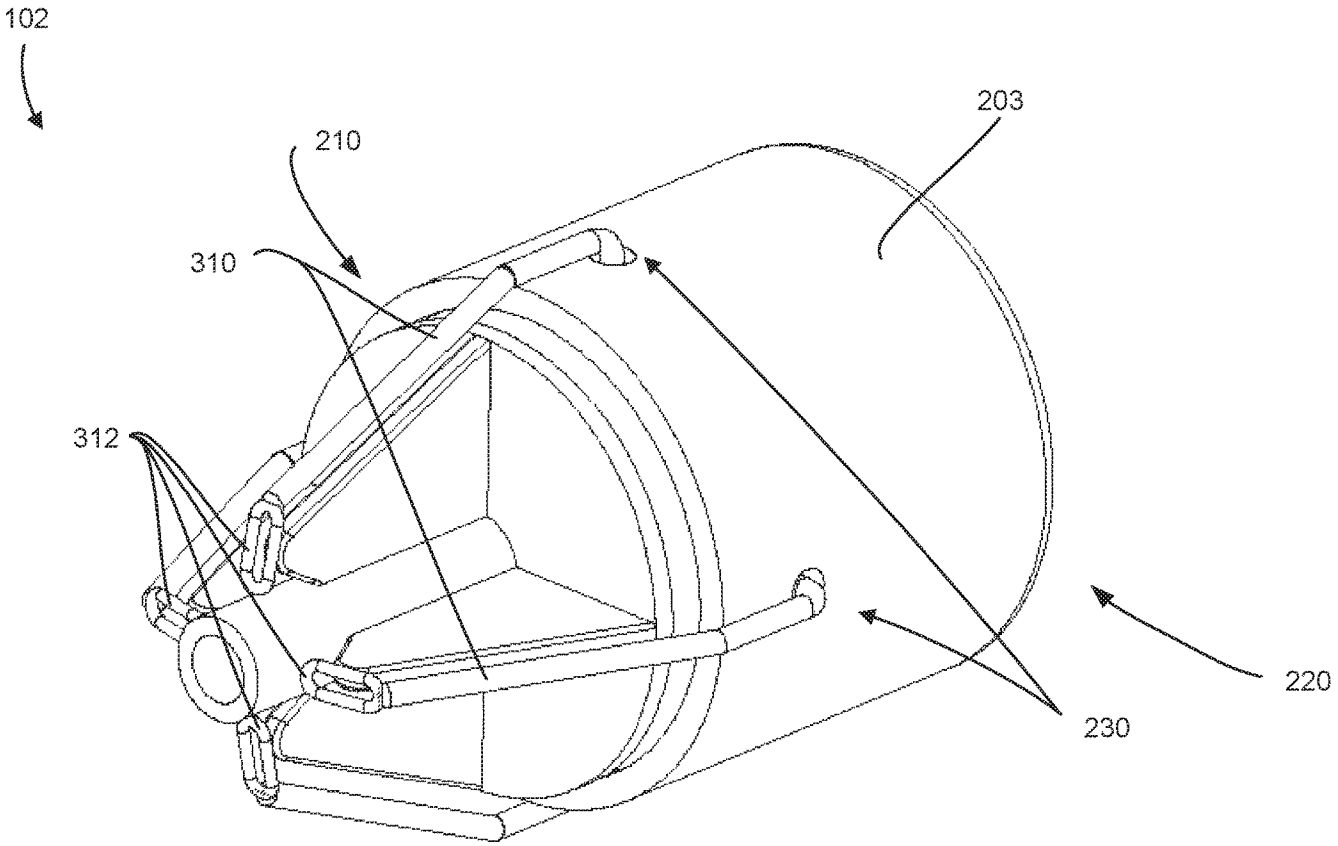
FIG. 8 is another isometric view of the example head assembly of FIG. 7.

FIGS. 7 and 8 depict an alternate embodiment of the padded head assembly. As shown in this embodiment, a passage or passages 230 may pass through the foam tip 203 substantially perpendicular to the axis of an arrow equipped with an example of the padded head assembly. One end of a finger 310 of the elastic attachment mechanism may be secured in place to the base, the finger may then pass part of the way up the outside of the foam tip 203 before passing through the foam tip 203 to another point on the side of the foam tip 203, before extending back down the outside of the foam tip 203, where the other end of the finger would also be secured in place to the base.

Figure 15:
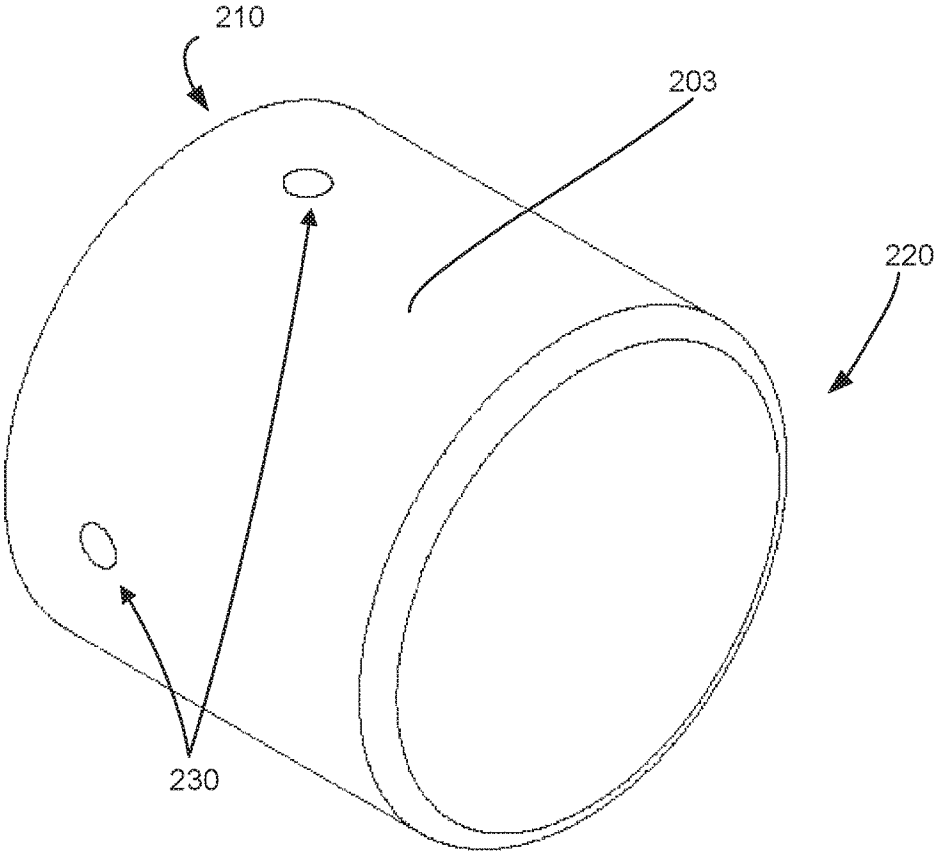
FIG. 15 is an isometric view of the example foam tip of FIG. 7.
Figure 16:
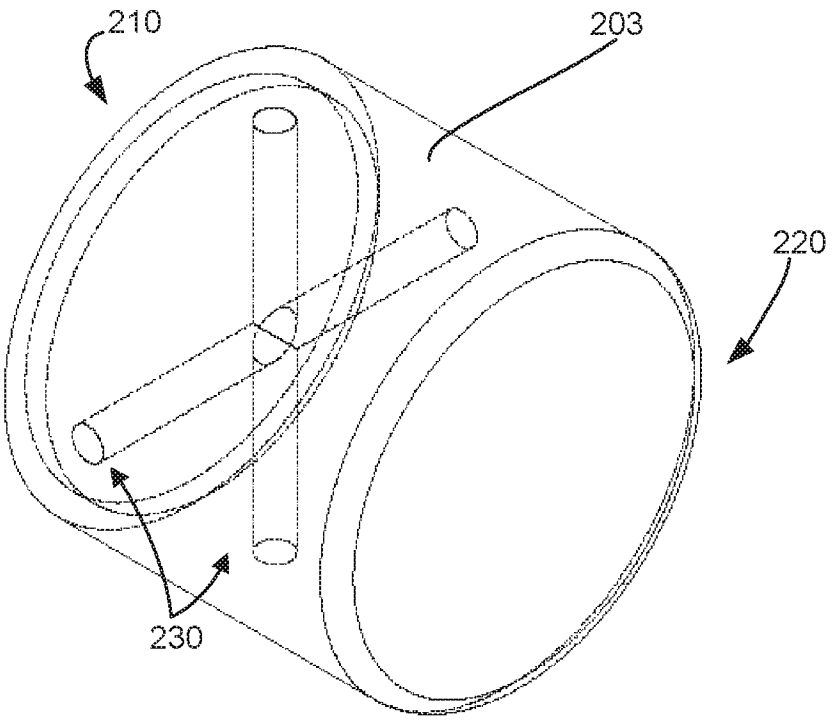
FIG. 16 is another isometric view of the example foam tip of FIG. 15.

The foam tip 203 depicted in FIGS. 7 and 8 is also depicted in FIGS. 15 and 16. As depicted, two passages 230 pass through the foam tip 203 perpendicular to the axis of an arrow equipped with an example of the padded head assembly. These passages each extend from a first point on the side of the cylindrical foam tip 203 to a point opposite the first point. However, the skilled person will appreciate that these passages need not pass from a first point to a point on the opposite side of the foam tip, passing directly through the center of the foam tip. The skilled person will appreciate that the passages may pass from a first point to a point anywhere else on the foam tip, provided a finger passed through the passage would bias at least a portion of the foam tip against the base.

As depicted in FIGS. 7 and 8, in some embodiments the ends of the fingers 310 may be secured to the base by means of integral or attached loops 312. In some embodiments these loops 312 may be placed in notches 470 formed in the base 400.

The skilled person will understand that the fingers of the elastic attachment mechanism may be either connected to one another or unconnected. In embodiments such as the particular embodiment depicted in FIGS. 7 and 8 the fingers may be unconnected fingers, such that each may be passed through passages in the foam tip.

Figure 9:
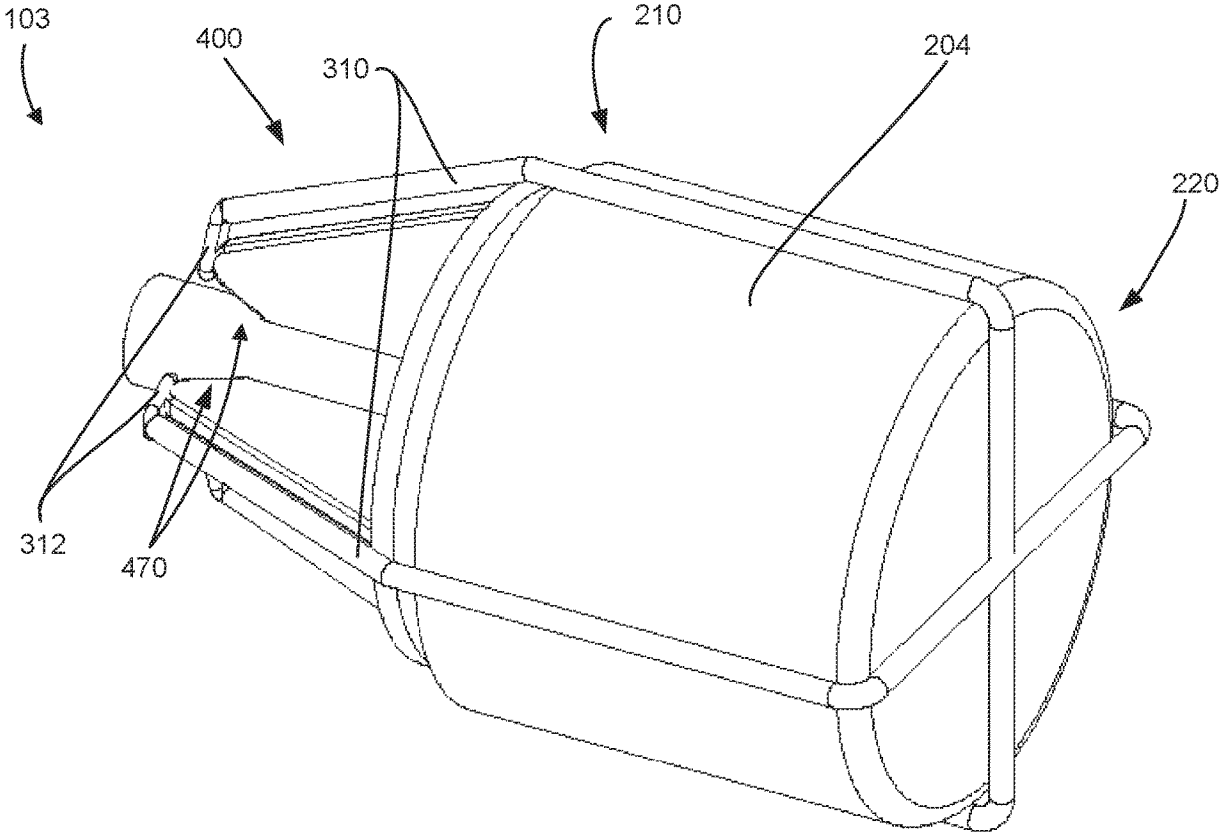
FIG. 9 is an isometric view of a padded head assembly according to a fourth embodiment.
Figure 10:
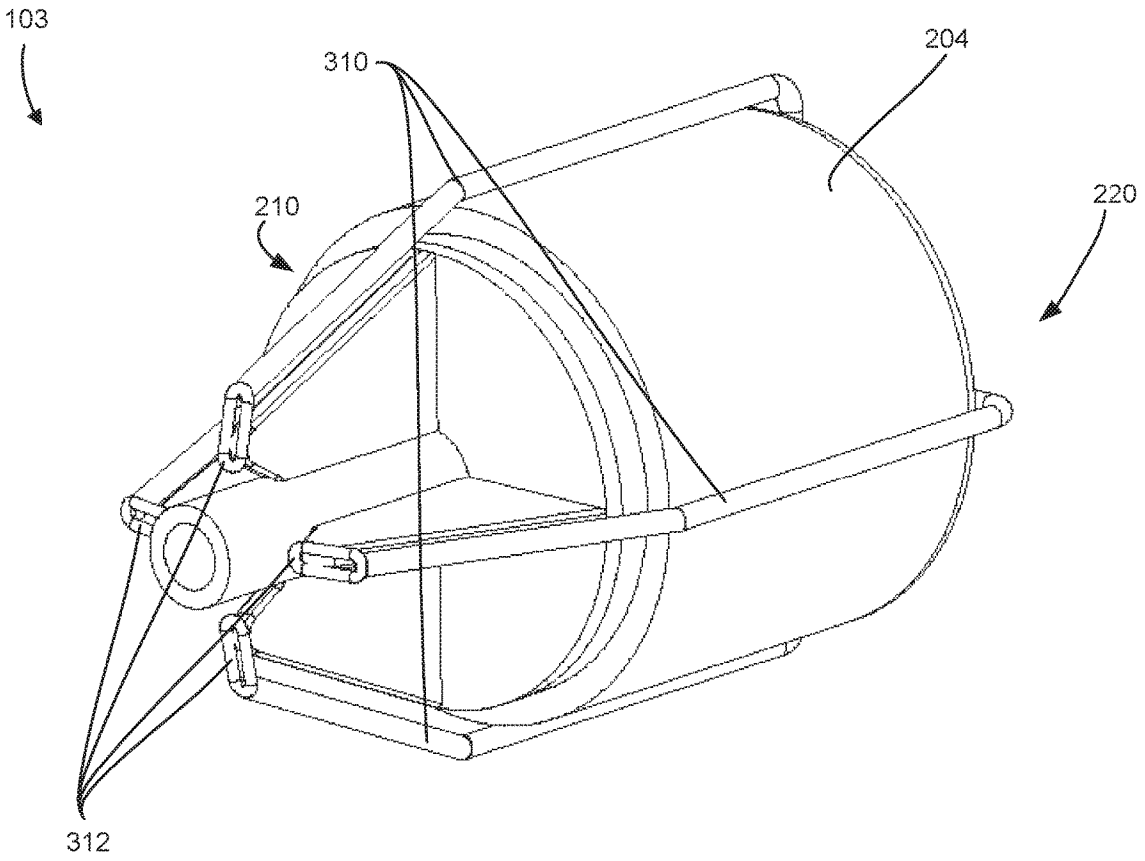
FIG. 10 is another isometric view of the example head assembly of FIG. 9.
Figure 11:
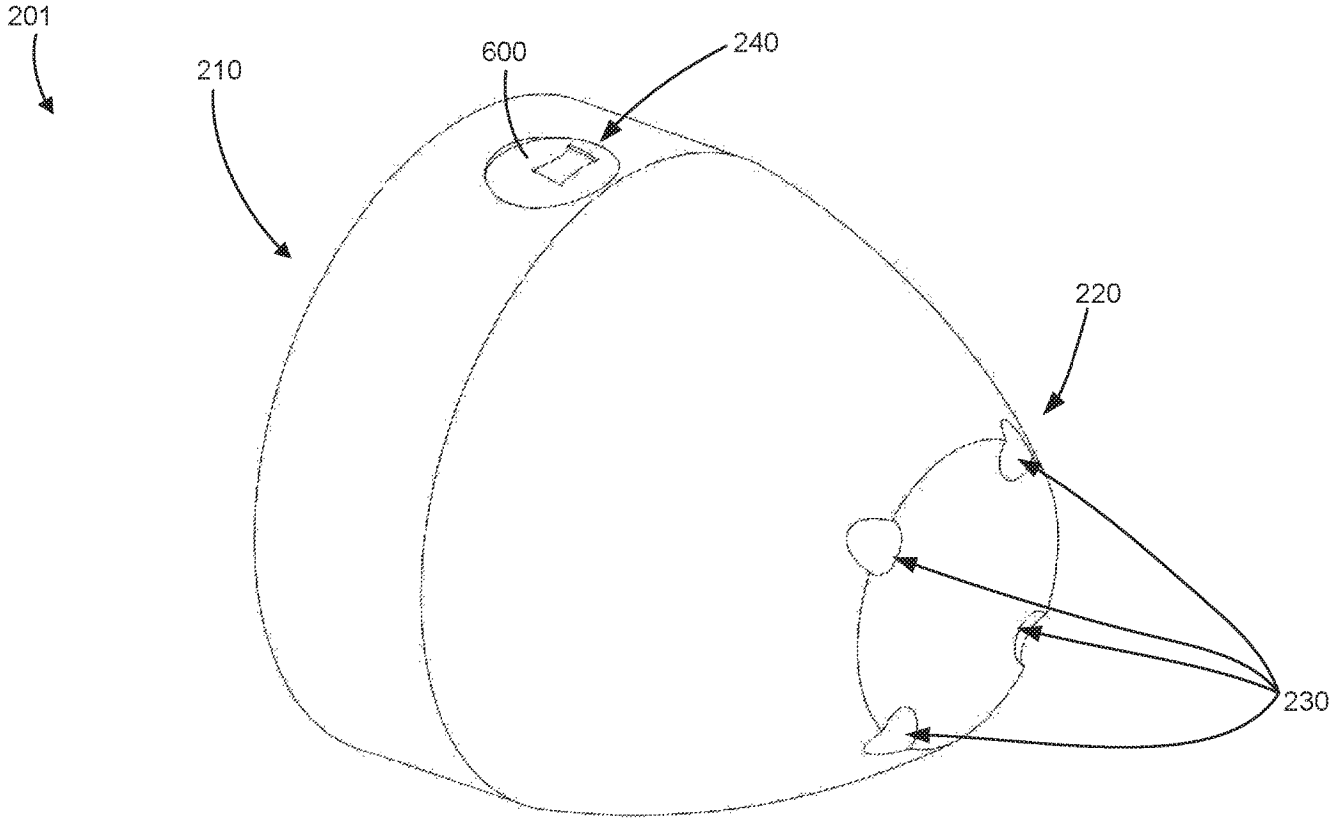
FIG. 11 is an isometric view of an example foam tip according to a first embodiment.
Figure 12:
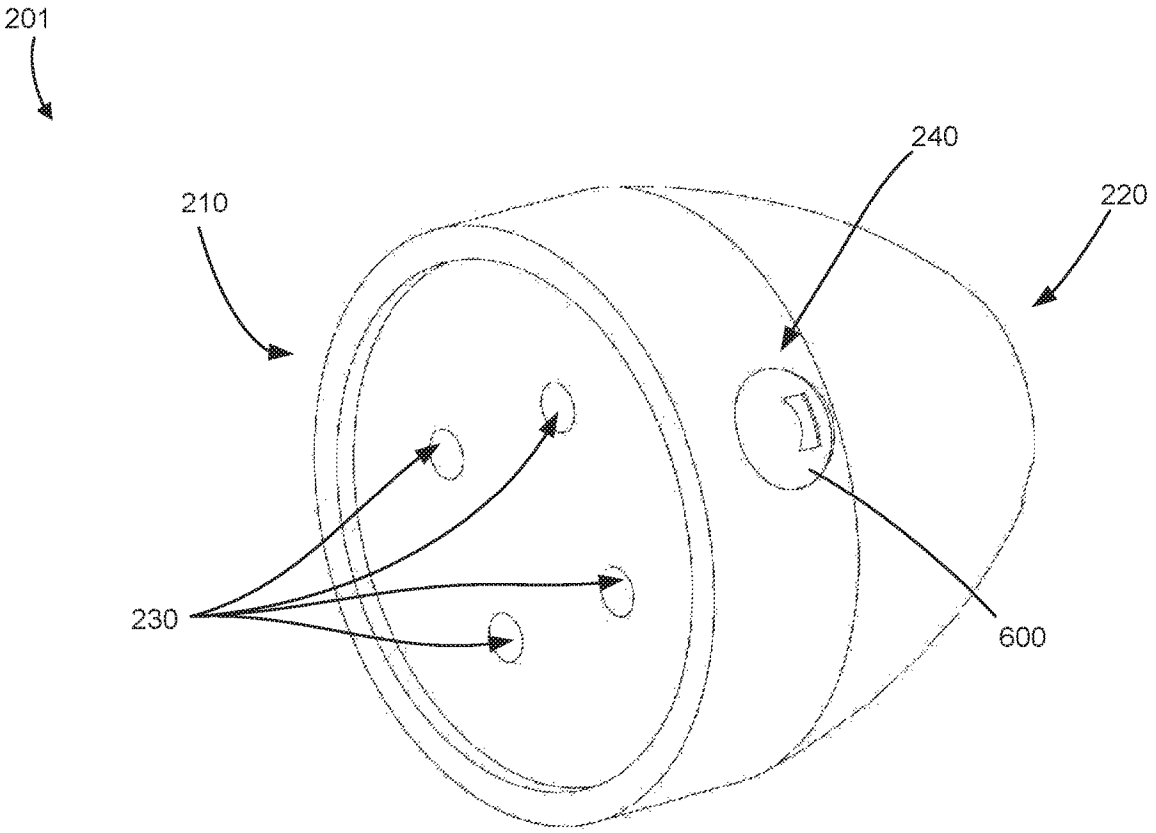
FIG. 12 is another isometric view of the example foam tip of FIG. 11.
Figure 13:
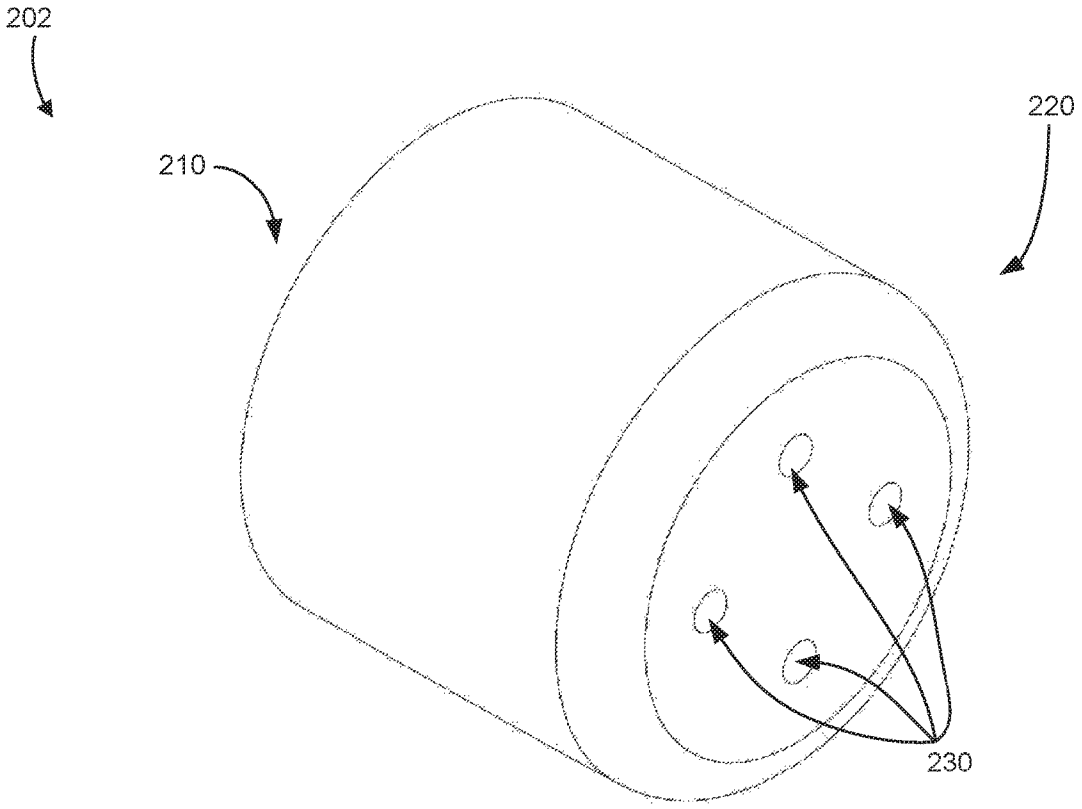
FIG. 13 is an isometric view of the example foam tip of FIG. 4.
Figure 14:
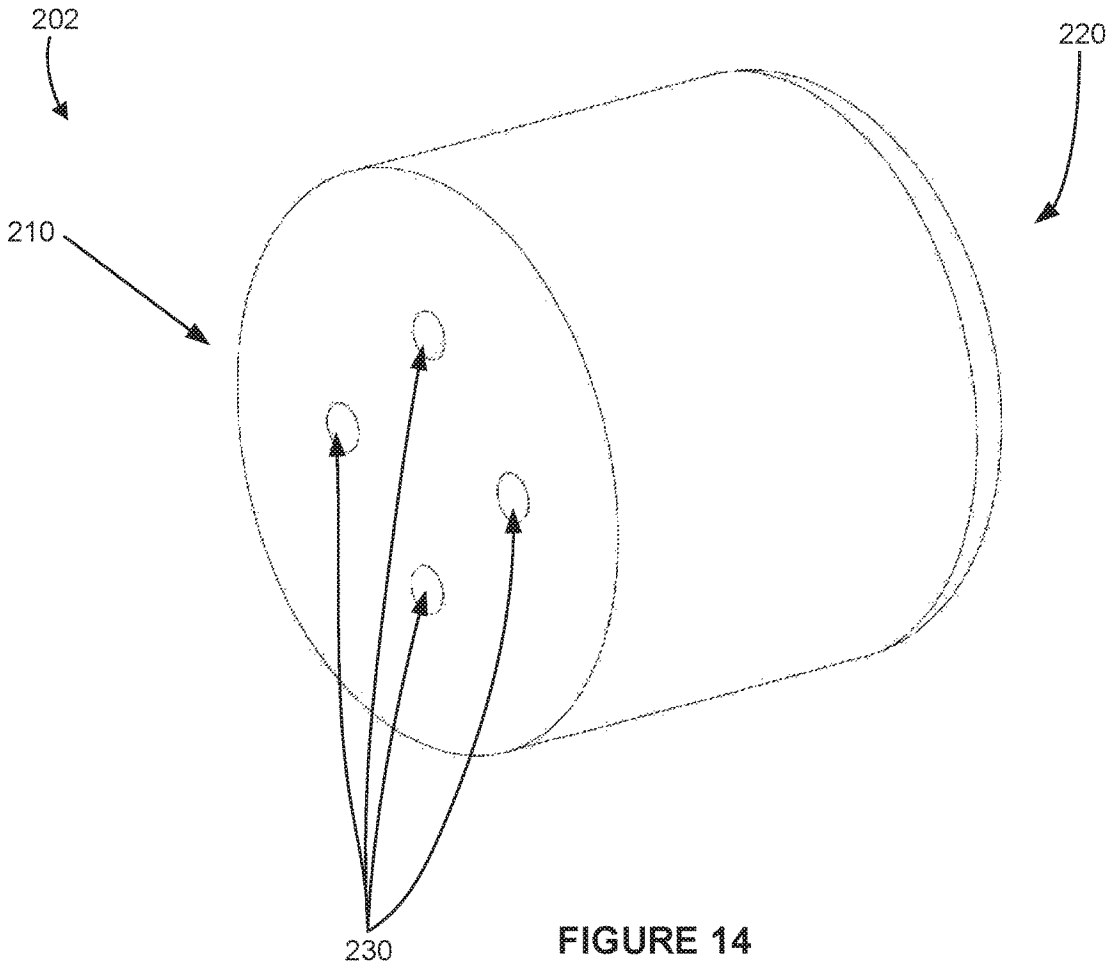
FIG. 14 is another isometric view of the example foam tip of FIG. 13.
Figure 17:
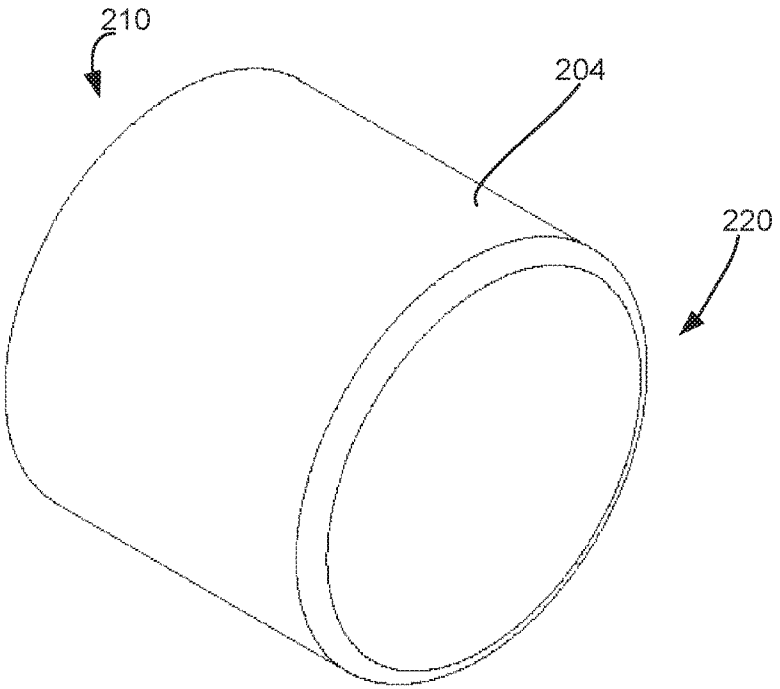
FIG. 17 is an isometric view of the example foam tip of FIG. 9.
Figure 18:
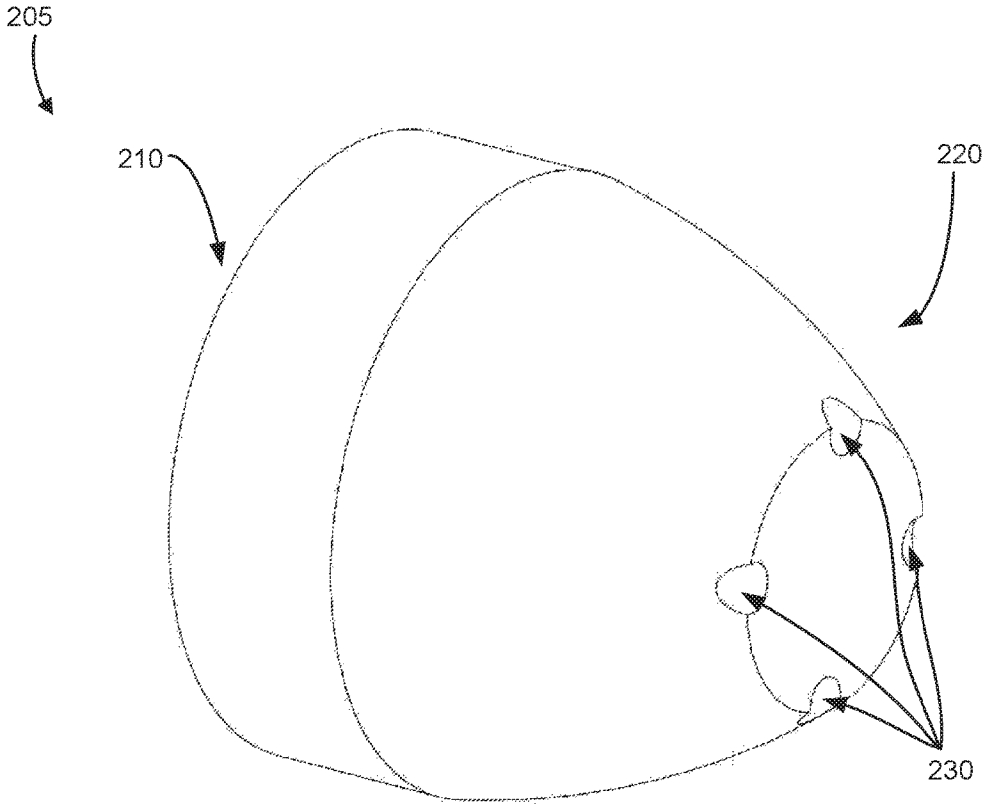
FIG. 18 is an isometric view of an example foam tip according to a fifth embodiment.
Figure 19:
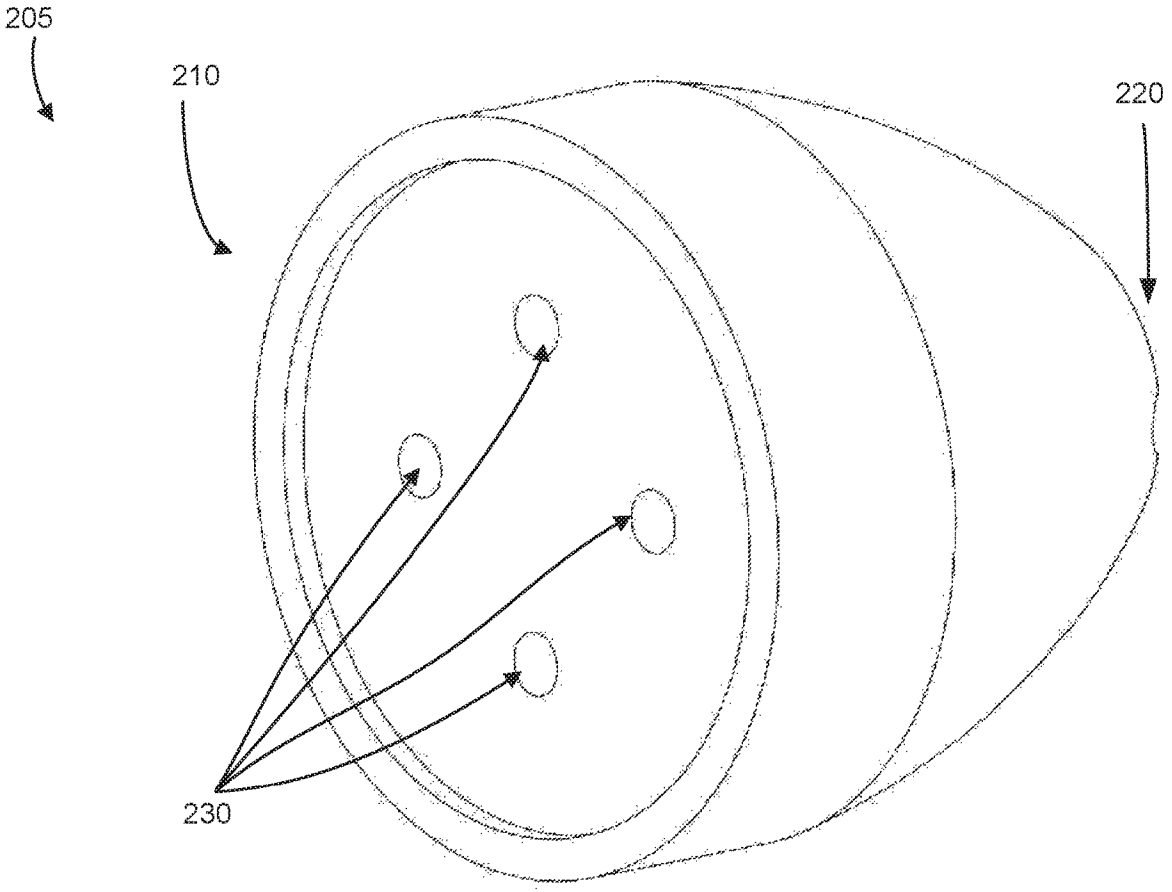
FIG. 19 is another isometric view of the example foam tip of FIG. 18.

FIGS. 9 and 10 depict another alternate embodiment of the padded head assembly. As shown in this embodiment, there may be no passages through the foam tip 204. In such an embodiment, the finger or fingers 310 of the elastic attachment mechanism may pass around the entirety of the foam tip 204 rather than through it. The foam tip depicted in FIGS. 9 and 10 is also depicted in FIG. 17.

The elastic attachment mechanism depicted in FIGS. 9 and 10 comprises two fingers 310 crossing each other. As depicted, the two fingers 310 are connected at the point where they cross. However, the skilled person will understand that the fingers may also be individual fingers, unconnected to one another.

Though only a few arrangements of elastic fingers have been detailed, the skilled person would understand that many additional arrangements of elastic fingers passing over the foam tip or through various configurations of passages in the foam tip may be used to secure the foam tip against the flat support pate.

The foam tip depicted in FIG. 3 further comprises a whistle insert cavity, holding a whistle insert 600. The whistle insert may be added either as a safety measure or to increase the thrill of a game involving the use of arrows equipped with a padded head assembly which includes a whistle insert.

The elastic attachment mechanism 300 depicted in FIG. 3 comprises two elastic fingers 310 crossing each other midway along their respective lengths. At the point at which the elastic fingers 310 cross, a reinforcing brace 320 has been added. This brace 320 may assist a foam tip 200, such as the foam tip 201 depicted here, in maintaining its physical integrity under the pressure of the elastic fingers.

The fingers 310 depicted in FIG. 3 are of non-uniform diameter. Each finger 310 may include one or more greater-diameter portions 311 to assist in securing the fingers 310 to the base 400. These greater-diameter portions 311 may keep the fingers from sliding free once the fingers are placed in securing notches 470 on the base 400. These greater-diameter portions 311 may also assist in securing the fingers 310 to the base 400 by other means. For example, the fingers 310 may be tied around the shaft connection end 410 of the base 400. Alternately, the finger or fingers may be secured to the base by being tied around the arrow shaft 500 with the knot resting against the base 400. Where the fingers are tied to the base or shaft rather then placed in notches, the greater-diameter portions 311 may assist in keeping the knots from slipping.

The person skilled in the art will understand that the elastic attachment mechanism 300 may be used without the greater-diameter portions 311 of the fingers 310. For example, the fingers 310 may be tied to the shaft connection end 410 of the base 400 or to the arrow shaft 500 with the knot resting against the base 400 without the use of the greater-diameter portions to assist in keeping the knots from slipping. Alternatively, the ends of the fingers 310 may be permanently secured in place to the base 400, by any means known to the person skilled in the art, such as by adhesive, integral molding, tape, etc.

Figure 22:
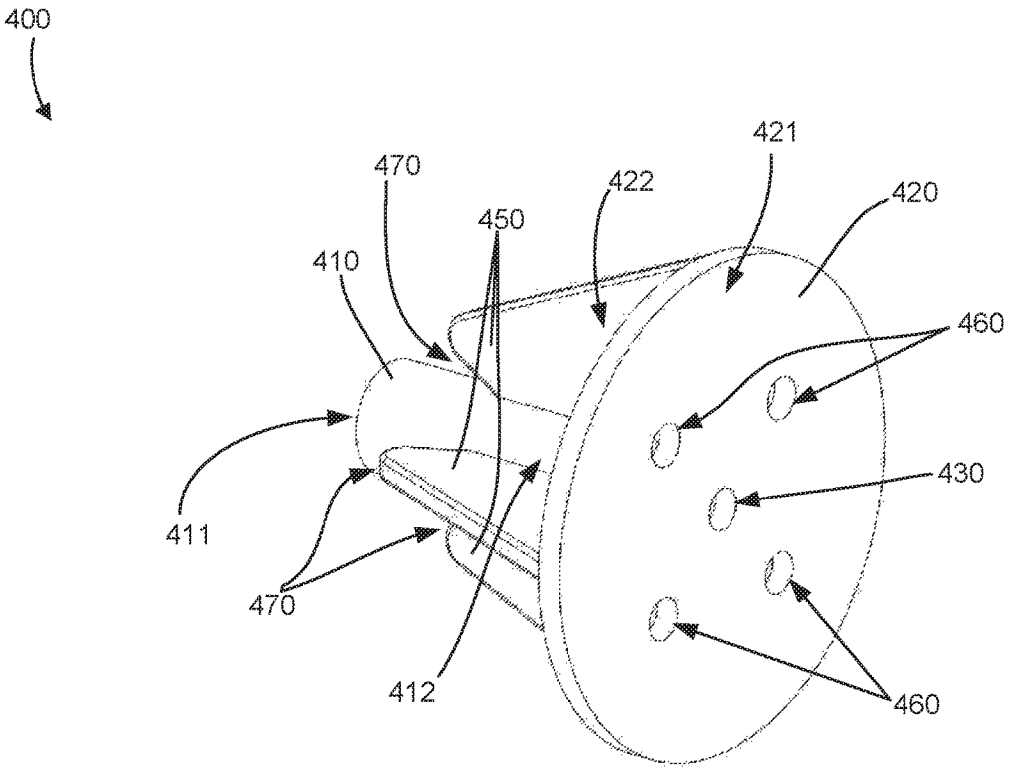
FIG. 22 is an isometric view of a first example base.
Figure 23:
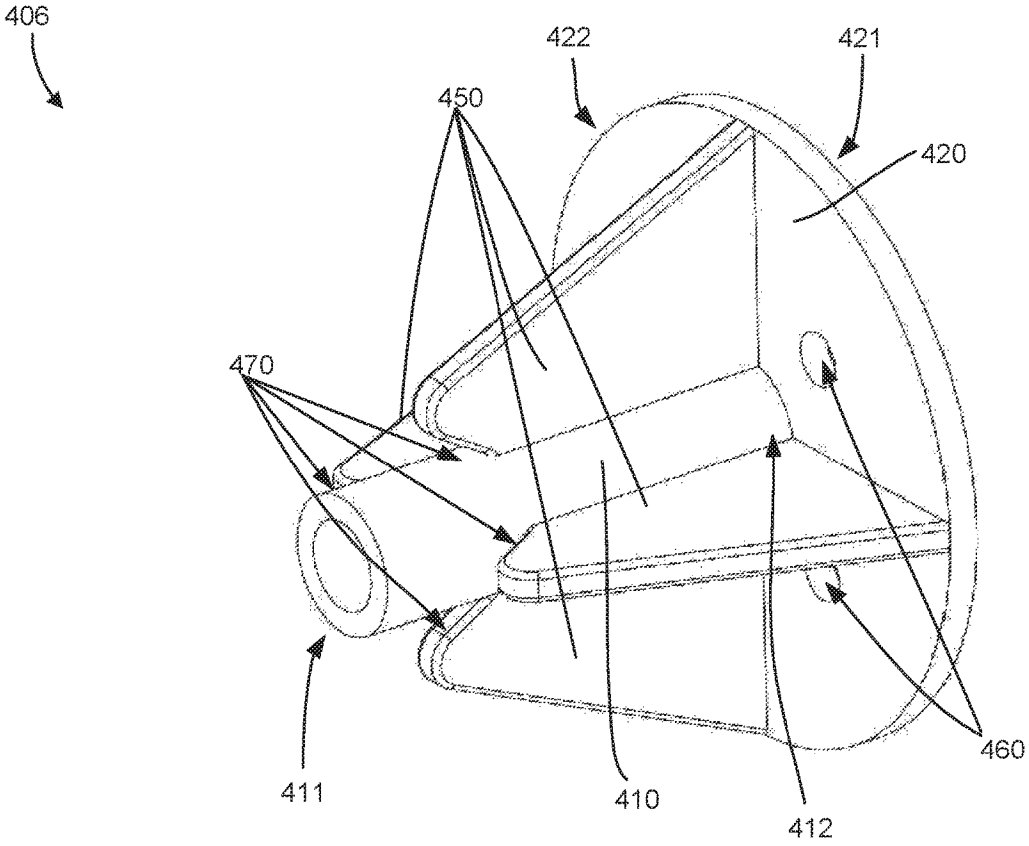
FIG. 23 is another isometric view of the first example base of FIG. 22.

The base 400 depicted in FIG. 3, and also depicted in FIGS. 22 and 23, comprises a shaft connection end 410 having a first end 411 and a second end 412. This shaft connection end 410 comprises an elongated cylindrical portion having a hollow interior. The base 400 further comprises a flat support plate 420, having an upper face 421 and a lower face 422. The second end 412 of the shaft connection end 410 is connected to the center of the lower face 422 of the flat support plate 420. This connection may be permanent, such as by integral molding, adhesive, or any other method known to one skilled in the art.

As depicted in FIG. 3, the base 400 may further comprise a central opening 430 through the flat supporting plate. This opening may line up with the hollow interior of the shaft connection end. The base 400 may further comprise a threaded fastener 440 which may pass through the central opening 430. This threaded fastener 440 may be threaded into the threaded insert 510 available in many commercially available arrow shafts 500. This threaded fastener 440 may removably but securely hold the base 400 and the arrow shaft 500 together.

The base 400 may further comprise one or more fins 450. These fins 450 may taper substantially downward from the second end 412 of the shaft connection end 410 of the base 400. These fins 450 may provide support for the flat support plate 420. These fins may optionally include a notch 470, which may be used in securing the fingers 310 of the elastic attachment mechanism 300 to the base 400, by placing the fingers 310 in the notches 470. The greater-diameter portions 311 of the fingers 310 may assist in retaining the fingers 310 within the notches 470 by preventing the fingers from sliding. The use of multiple greater-diameter portions 311 on each finger 310 may allow the finger to be adjusted to apply greater or lesser pressure in biasing the foam tip 200 against the base 400.

The base 400 may further comprise one or more holes or slots 460. These holes or slots 460 are meant to permit the fingers 310 of the elastic attachment mechanism 300 to extend past the flat support pate 420 without passing over the outer rim of the flat support plate 420. In FIG. 3 the base 400 is depicted as comprising four holes 460 through which the fingers 310 may pass before being secured in the notches 470 on the base 400. However, the skilled person will understand that slots in the rim of the flat support plate 420 may also be used to allow the finger or fingers to pass the flat support plate 420 without extending over the outer rim of the flat support plate 420.

FIG. 3 further depicts a whistle insert 600, a protective housing 700, and a retaining ring 800. The whistle insert 600 is provided for the reasons detailed above and may be shaped in any way known to a person skilled in the art. For example, the whistle insert 600 may be shaped as a hollow cylinder. The cylinder may be inserted into a cylindrical cavity in the side of an example foam tip 200, as it is shown in FIG. 3 inserted into the side of foam tip 201. The cylinder may be substantially closed on at least the end facing out of the cavity, save for a slit.

The protective housing 700 depicted in FIG. 3 is shaped substantially as a hollow conical frustum. The protective housing 700 may be inserted onto the arrow shaft 500 and may cover at least a portion of the padded head assembly 100. The protective housing may assist in keeping the elastic fingers 310 from detaching from the base 400, for example by preventing accidental or intentional tampering. The protective housing may also assist in reducing wear and tear on the base. The person skilled in the art will understand that any shape protective housing may be used, provided it covers and protects at least a portion of the padded head assembly.

The protective housing 700 may be kept in place by an elastic retaining ring 800. The elastic retaining ring 800 may be elastically extended and positioned on an arrow shaft 500 around the circumference of the shaft. The elastic retaining ring 800 may be placed against the narrow side of the protective housing 700. This position may assist in keeping the protective housing form sliding along the arrow shaft 500 away from the at least a portion of the padded head assembly 100 that it is meant to protect.

FIGS. 11 and 12, 13 and 14, 15 and 16, 17, and 18 and 19 depict respectively a first embodiment of the foam tip 201, a second embodiment of the foam tip 202, a third embodiment of the foam tip 203, a fourth embodiment of the foam tip 204, and a fifth embodiment of the foam tip 205. The first embodiment 201 includes a whistle insert 600. The first and fifth embodiments 201 and 205 comprise a cylindrical piece of foam, the second end 220 of which has been substantially rounded off to assist with the flight of an arrow equipped with a padded head assembly.

Figure 20:
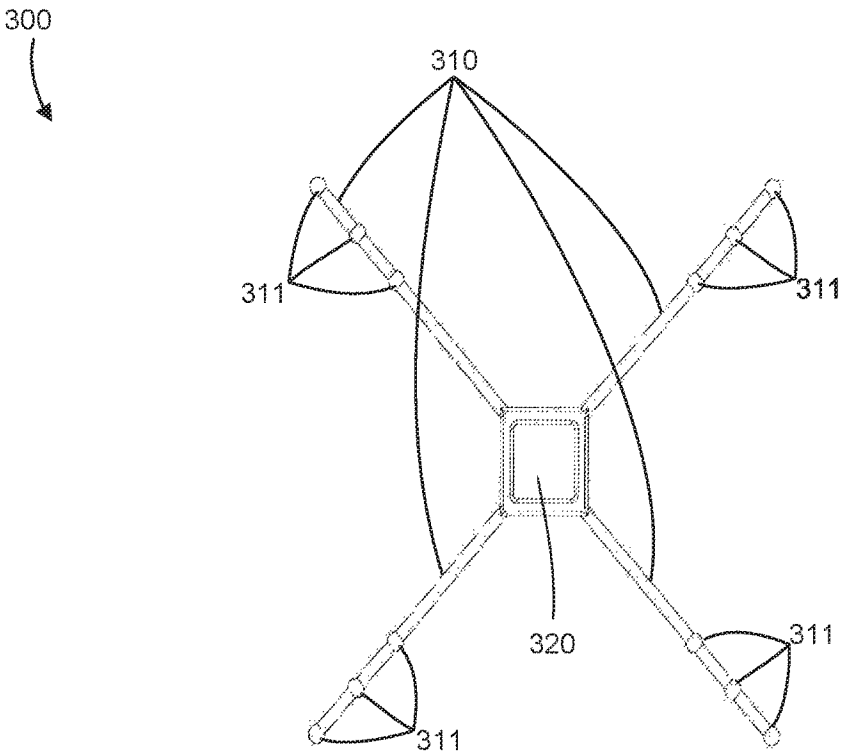
FIG. 20 is a top view of a first example elastic attachment mechanism with the elastic fingers extended in a common plane.

FIG. 20 depicts an example of the elastic attachment mechanism 300. In this example two elastic fingers 310, each having three greater-diameter portions 311 on each end, are crossed midway along their lengths. At the point where the two fingers cross a supporting brace 320 has been added for greater strength and to keep the fingers 310 from compromising the physical integrity of any foam tip they are used to secure. The elastic attachment mechanism 300 depicted in FIG. 20 is laid flat, with the elastic fingers extending out in a cross shape.

Figure 21:
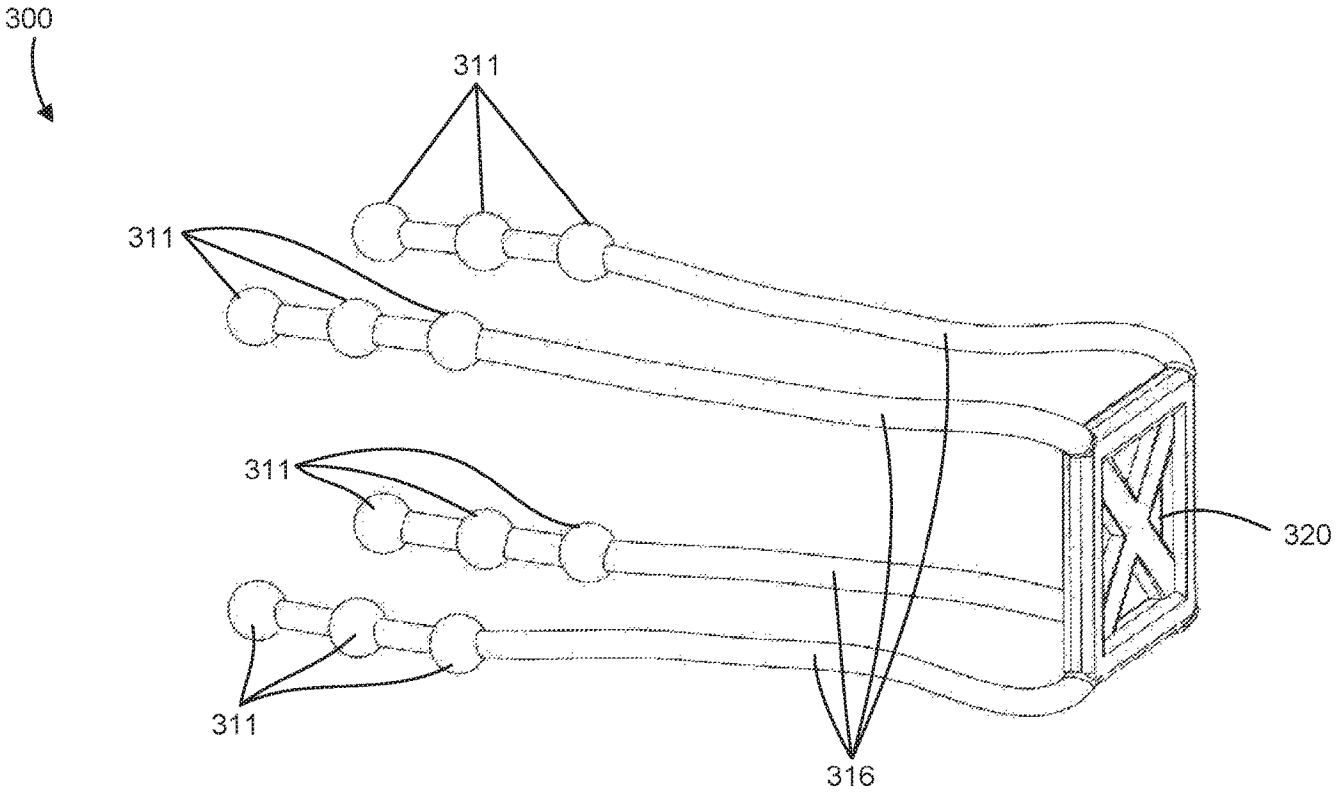
FIG. 21 is an isometric view of the first example elastic attachment mechanism of FIG. 20 with the ends of the fingers drawn back in a common direction.

FIG. 21 depicts the elastic attachment mechanism 300 depicted in FIG. 20. However, in FIG. 21 the ends of the elastic fingers 310 are drawn back in one direction as they would be when the elastic attachment mechanism 300 is used to secure a foam tip against a base.

As described above, FIGS. 22 to 26 depict examples of components that may be used in an example padded head assembly.

Figure 27:
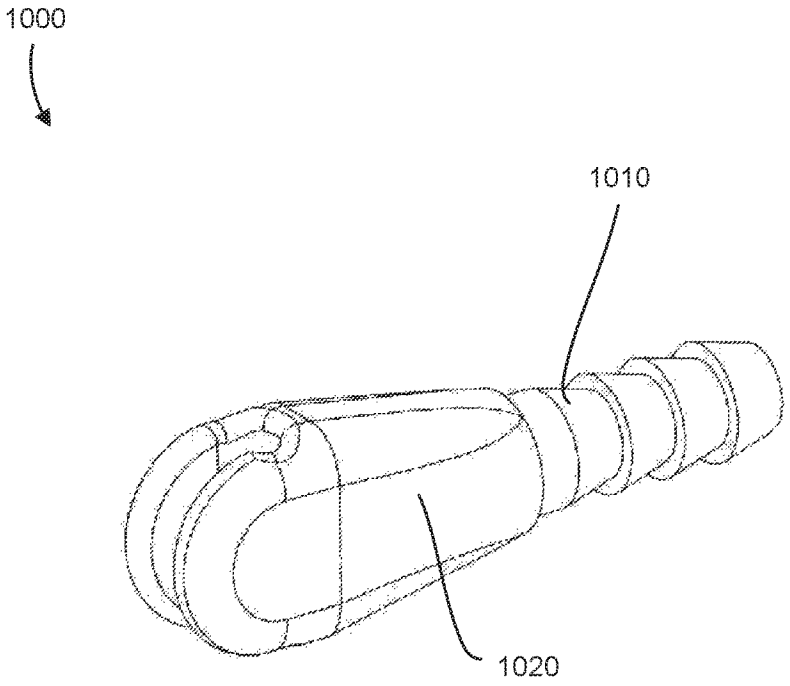
FIG. 27 is an isometric view of a first example nock.

FIG. 27 depicts a nock 1000. The nock 1000 comprises a nock insert 1010 and a nock extension 1020. The nock insert 1010 is inserted into the shaft tail end 520 of a commercially available arrow shaft. The nock insert 1010 may be barbed to better enable the nock to be held in the shaft by friction. The nock would be shaped as known to one skilled in the art; with a aperture on the nock extension 1020 capable of holding an arrow string.

The typical nock on an arrow often makes a convenient handle for an archer seeking to nock the arrow on a bowstring. The continued use of the nock as a handle puts strain on the nock that it is not able to bear. As a result, the portion of the nock extending beyond the shaft often breaks off after regular use. However, in an aspect, the nock 1000 may be made with a smaller nock extension 1020 that is no longer a convenient handle. As a result, an archer is likely to grasp the arrow by holding onto the shaft tail end 520 rather than the nock 1000.

The durability of the nock 1000 may also be improved by manufacturing the nock 1000 of a flexible material, such as Santoprene 103-40 rather than the commonly used high-density polyethylene (HDPE).

One skilled in the art will understand that the nock 1000 may be formed without the barbs on the extension and may be held in place frictionally, or by other means such as adhesive, tape, or any other means known to one skilled in the art.

As the skilled person will appreciate, the embodiments described in this document are largely modular, in that most components may be replaced individually when necessary. As the skilled person will appreciate, such a design permits components to be replaced without requiring the entire padded head assembly to be replaced.

In addition, the wear and tear upon these arrow heads often causes certain components to wear out faster than others. As a result, there is a need for a substantially modular non-lethal arrow head design, allowing components to be replaced individually when necessary.

A number of embodiments have been described herein. However, it will be understood by persons skilled in the art that other variants and modifications may be made without departing from the scope of the embodiments as defined in the claims appended hereto. A person skilled in the art will also recognize that the embodiments described above should be read as representative of a plethora of permutations not explicitly described, said permutations incorporating elements from various embodiments.

The invention claimed is:

1. A padded head assembly for an arrow, comprising:

a) a foam tip having an impact end and a base connection end;

b) an elastic attachment mechanism comprising one or more elastic fingers; and c) a base, comprising a shaft connection end and a flat supporting plate end;

wherein the base connection end of the foam tip rests against the flat supporting plate of the base, the ends of the finger or fingers are secured to the base, and the finger or fingers wrap around at least a portion of the foam tip, holding the foam tip in place against the flat supporting plate end of the base, wherein the base comprises:

a) a shaft connection end comprising an elongated cylindrical portion having a hollow interior and having first and second ends, wherein an arrow shaft can be fitted into the hollow interior from the first end; and b) a flat support plate having upper and lower faces;

wherein the second end of the elongate cylindrical portion is connected to the center of the lower face of the flat support plate, wherein the flat support plate has one or more holes or slots through which the fingers of the elastic attachment mechanism can pass so that they need not pass over an outer rim of the flat support plate.

2. The padded head assembly of claim 1, wherein the flat support plate also has a central opening, positioned in line with the hollow interior of the elongate cylindrical portion.

3. The padded head assembly of claim 2, wherein the base is attached to the arrow shaft by a threaded fastener which is designed to pass through the central opening from the upper face to the lower face and threaded into a threaded insert located on one end of a commercially available arrow shaft having a shaft tail end and a shaft head end.

4. The padded head assembly of claim 1, wherein the base is attached to the arrow shaft by a threaded fastener which is integrally attached to the base and positioned in line with the hollow interior of the elongate cylindrical portion, extending away from the lower face of the flat support plate.

5. The padded head assembly of claim 1, wherein the base further comprises a plurality of fins tapering downwards from the flat support plate and attached to the elongated cylindrical portion to provide support for the flat support plate.

6. The padded head assembly of claim 1, wherein the foam tip is a solid piece of foam without cavities except for a whistle insert cavity.

7. The padded head assembly of claim 6, wherein the whistle insert cavity is in the side of the foam tip.

8. The padded head assembly of claim 1, wherein the foam tip is cylindrical in shape along a longitudinal axis, with a first and second end; the first end being flat and the second end shaped as a half sphere.

9. The padded head assembly of claim 1, wherein one or more passages are provided through the foam tip through which the elastic attachment mechanism can pass.

10. The padded head assembly of claim 1, further comprising a protective housing wherein the protective housing covers at least a portion of the base.

11. The padded head assembly of claim 10, wherein the protective housing is a sleeve substantially in the shape of a hollow conical frustum.

12. The padded head assembly of claim 10, further comprising an elastic retaining ring elastically extended and positioned on the shaft with its axis parallel to the axis of the shaft and against the protective housing.

13. The padded head assembly of claim 1, further comprising:

a) an arrow shaft attached to the shaft connection end of the base of the padded head assembly; and b) a fletching sleeve slid onto the shaft tail end of the arrow shaft and positioned on the arrow shaft in a position which balances the padded head assembly during flight.

14. A padded head assembly for an arrow comprising:

a) a foam tip having an impact end and a base connection end;

b) an elastic attachment mechanism comprising one or more elastic fingers; and c) a base, comprising a shaft connection end and a flat supporting plate end;

wherein the base connection end of the foam tip rests against the flat supporting plate of the base, the ends of the finger or fingers are secured to the base, and the finger or fingers wrap around at least a portion of the foam tip, holding the foam tip in place against the flat supporting plate end of the base, wherein the base comprises:

a) a shaft connection end comprising an elongated cylindrical portion having a hollow interior and having first and second ends, wherein an arrow shaft can be fitted into the hollow interior from the first end; and b) a flat support plate having upper and lower faces;

wherein the second end of the elongate cylindrical portion is connected to the center of the lower face of the flat support plate, wherein the base further comprises a plurality of fins tapering downwards from the flat support plate and attached to the elongated cylindrical portion to provide support for the flat support plate, wherein the fins each include at least one securing notch to hold the fingers of the elastic attachment mechanism.

15. The padded head assembly of claim 14, wherein the one or more elastic fingers are of non-uniform diameter, so that one or more portions of each particular finger are of greater diameter than a remainder of the particular finger, which can be used to secure the fingers to the base by placing the particular finger in the securing notches in the fins.

* * * * *